US009818262B2

(12) United States Patent
Arnone et al.

(10) Patent No.: US 9,818,262 B2
(45) Date of Patent: Nov. 14, 2017

(54) GAME WORLD SERVER DRIVEN TRIGGERING FOR GAMBLING HYBRID GAMING SYSTEM

(71) Applicant: Gamblit Gaming, LLC, Glendale, CA (US)

(72) Inventors: Miles Arnone, Sherborn, MA (US); Frank Cire, Pasadena, CA (US)

(73) Assignee: Gamblit Gaming, LLC, Glendale, CA (US)

( * ) Notice: Subject to any disclaimer, the term of this patent is extended or adjusted under 35 U.S.C. 154(b) by 0 days.

(21) Appl. No.: 14/867,809

(22) Filed: Sep. 28, 2015

(65) Prior Publication Data

US 2016/0019756 A1 Jan. 21, 2016

Related U.S. Application Data

(63) Continuation of application No. PCT/US2014/031519, filed on Mar. 21, 2014.

(60) Provisional application No. 61/805,878, filed on Mar. 27, 2013.

(51) Int. Cl.
*G07F 17/32* (2006.01)

(52) U.S. Cl.
CPC ..... *G07F 17/3262* (2013.01); *G07F 17/3267* (2013.01)

(58) Field of Classification Search
CPC ... G07F 17/32; G07F 17/3262; G07F 17/3267
USPC ..... 463/9, 16, 23, 25
See application file for complete search history.

(56) References Cited

U.S. PATENT DOCUMENTS

| | | | | |
|---|---|---|---|---|
| 5,413,357 | A | 5/1995 | Schulze et al. | |
| 5,718,429 | A * | 2/1998 | Keller, Jr. ..... | A63F 3/00157 273/274 |
| 5,785,592 | A | 7/1998 | Jacobsen | |
| 5,853,324 | A | 12/1998 | Kami et al. | |
| 5,963,745 | A | 10/1999 | Collins et al. | |
| 6,050,895 | A | 4/2000 | Luciano | |
| 6,165,071 | A | 12/2000 | Weiss | |
| 6,227,974 | B1 | 5/2001 | Eilat | |

(Continued)

FOREIGN PATENT DOCUMENTS

WO 2012123780 A1 9/2012

OTHER PUBLICATIONS

U.S. Appl. No. 14/185,847 Arnone, et al., filed Feb. 20, 2014.

(Continued)

*Primary Examiner* — David L Lewis
*Assistant Examiner* — Shauna-Kay Hall
(74) *Attorney, Agent, or Firm* — Caitlyn Ross

(57) ABSTRACT

A gambling hybrid game that provides game world engine driven triggering of gambling events is disclosed. The gambling hybrid game includes an entertainment system engine that provides an entertainment game to a user, a real world engine that provides gambling games to users, and a game world engine that monitors the entertainment game and provides gambling games when appropriate. The entertainment system engine provides an entertainment games that provides values for a set of entertainment game variables. The game world engine receive the values of set of entertainment game variables and determined whether a gambling event in a gambling game is triggered based upon the values one or more entertainment game variables in the set.

15 Claims, 18 Drawing Sheets

(56) References Cited

U.S. PATENT DOCUMENTS 6,267,669 B1 7/2001 Luciano
6,685,563 B1 2/2004 Meekins et al.
6,712,693 B1 3/2004 Hettinger
6,761,632 B2 7/2004 Bansemer et al.
6,761,633 B2 7/2004 Riendeau
6,764,397 B1 7/2004 Robb
6,811,482 B2 11/2004 Letovsky
7,118,105 B2 10/2006 Benevento
7,294,058 B1 11/2007 Slomiany
7,326,115 B2 2/2008 Baerlocher
7,361,091 B2 4/2008 Letovsky
7,517,282 B1 4/2009 Pryor
7,575,517 B2 8/2009 Parham et al.
7,682,239 B2 * 3/2010 Friedman ..... G07F 17/3295 463/16
7,720,733 B2 5/2010 Jung
7,753,770 B2 7/2010 Walker et al.
7,753,790 B2 7/2010 Nguyen
7,766,742 B2 8/2010 Bennett et al.
7,775,885 B2 8/2010 Van Luchene
7,798,896 B2 9/2010 Katz
7,828,657 B2 11/2010 Booth
7,917,371 B2 3/2011 Jung et al.
7,938,727 B1 5/2011 Konkle
7,967,674 B2 6/2011 Baerlocher
7,980,948 B2 7/2011 Rowe
7,996,264 B2 8/2011 Kusumoto et al.
8,012,023 B2 9/2011 Gates
8,047,908 B2 11/2011 Walker
8,047,915 B2 11/2011 Lyle
8,060,829 B2 11/2011 Jung et al.
8,075,383 B2 12/2011 Friedman et al.
8,087,999 B2 1/2012 Oberberger
8,113,938 B2 2/2012 Friedman et al.
8,118,654 B1 2/2012 Nicolas
8,128,487 B2 3/2012 Hamilton et al.
8,135,648 B2 3/2012 Oram
8,137,193 B1 3/2012 Kelly et al.
8,142,272 B2 3/2012 Walker
8,157,653 B2 4/2012 Buhr
8,167,699 B2 5/2012 Inamura
8,177,628 B2 5/2012 Manning
8,182,338 B2 5/2012 Thomas
8,182,339 B2 5/2012 Anderson
8,187,068 B2 5/2012 Slomiany
8,206,210 B2 6/2012 Walker
8,308,544 B2 11/2012 Friedman
8,475,266 B2 7/2013 Arnone
8,480,470 B2 7/2013 Napolitano et al.
8,622,809 B1 1/2014 Arora et al.
2001/0004609 A1 6/2001 Walker et al.
2001/0019965 A1 9/2001 Ochi
2002/0022509 A1 2/2002 Nicastro et al.
2002/0090990 A1 7/2002 Joshi et al.
2002/0160825 A1 * 10/2002 Nicastro ..... G07F 17/32 463/16
2002/0175471 A1 11/2002 Faith
2003/0060286 A1 3/2003 Walker et al.
2003/0119576 A1 6/2003 McClintic et al.
2003/0139214 A1 7/2003 Wolf et al.
2003/0171149 A1 9/2003 Rothschild
2003/0177187 A1 * 9/2003 Levine ..... A63F 13/10 709/205
2003/0204565 A1 10/2003 Guo et al.
2003/0211879 A1 11/2003 Englman
2004/0092313 A1 5/2004 Saito et al.
2004/0097610 A1 5/2004 Kashiwame
2004/0102238 A1 5/2004 Taylor
2004/0121839 A1 6/2004 Webb
2004/0225387 A1 11/2004 Smith
2005/0003878 A1 1/2005 Updike
2005/0096124 A1 5/2005 Stronach
2005/0116411 A1 6/2005 Herrmann et al.
2005/0192087 A1 9/2005 Friedman et al.
2005/0233791 A1 10/2005 Kane
2005/0233806 A1 10/2005 Kane et al.
2005/0239538 A1 * 10/2005 Dixon ..... G07F 17/3267 463/20
2005/0269778 A1 12/2005 Samberg
2005/0288101 A1 12/2005 Lockton et al.
2006/0003823 A1 1/2006 Zhang
2006/0003830 A1 1/2006 Walker et al.
2006/0035696 A1 2/2006 Walker
2006/0040735 A1 2/2006 Baerlocher
2006/0068913 A1 3/2006 Walker et al.
2006/0084499 A1 4/2006 Moshal
2006/0084505 A1 4/2006 Yoseloff
2006/0135250 A1 6/2006 Rossides
2006/0154710 A1 7/2006 Serafat
2006/0166729 A1 7/2006 Saffari et al.
2006/0189371 A1 8/2006 Walker et al.
2006/0190865 A1 * 8/2006 Yu ..... G06F 17/504 716/106
2006/0223611 A1 10/2006 Baerlocher
2006/0234791 A1 10/2006 Nguyen et al.
2006/0240890 A1 10/2006 Walker
2006/0246403 A1 11/2006 Monpouet et al.
2006/0258433 A1 11/2006 Finocchio et al.
2007/0026924 A1 2/2007 Taylor
2007/0035548 A1 2/2007 Jung et al.
2007/0038559 A1 2/2007 Jung et al.
2007/0064074 A1 3/2007 Silverbrook et al.
2007/0087799 A1 4/2007 Van Luchene
2007/0093299 A1 * 4/2007 Bergeron ..... G07F 17/32 463/43
2007/0099696 A1 5/2007 Nguyen et al.
2007/0117641 A1 5/2007 Walker et al.
2007/0129149 A1 6/2007 Walker
2007/0142108 A1 6/2007 Linard
2007/0156509 A1 7/2007 Jung et al.
2007/0167212 A1 7/2007 Nguyen
2007/0167239 A1 * 7/2007 O'Rourke ..... G07F 17/32 463/42
2007/0173311 A1 7/2007 Morrow et al.
2007/0191104 A1 8/2007 Van Luchene
2007/0202941 A1 8/2007 Miltenberger
2007/0203828 A1 8/2007 Jung et al.
2007/0207847 A1 9/2007 Thomas
2007/0259717 A1 11/2007 Mattice
2007/0293306 A1 12/2007 Nee et al.
2008/0004107 A1 1/2008 Nguyen et al.
2008/0014835 A1 1/2008 Weston et al.
2008/0015004 A1 * 1/2008 Gatto ..... G07F 17/32 463/16
2008/0064488 A1 3/2008 Oh
2008/0070659 A1 3/2008 Naicker
2008/0070690 A1 3/2008 Van Luchene
2008/0070702 A1 3/2008 Kaminkow
2008/0096665 A1 4/2008 Cohen
2008/0108406 A1 5/2008 Oberberger
2008/0108425 A1 5/2008 Oberberger
2008/0113704 A1 5/2008 Jackson
2008/0119283 A1 5/2008 Baerlocher
2008/0146308 A1 6/2008 Okada
2008/0161081 A1 7/2008 Berman
2008/0176619 A1 7/2008 Kelly et al.
2008/0191418 A1 8/2008 Lutnick et al.
2008/0195481 A1 8/2008 Lutnick
2008/0248850 A1 10/2008 Schugar
2008/0254893 A1 10/2008 Patel
2008/0274796 A1 11/2008 Lube
2008/0274798 A1 11/2008 Walker et al.
2008/0311980 A1 12/2008 Cannon
2008/0318668 A1 12/2008 Ching
2009/0011827 A1 1/2009 Englman
2009/0023489 A1 1/2009 Toneguzzo
2009/0023492 A1 1/2009 Erfanian
2009/0061974 A1 3/2009 Lutnick et al.
2009/0061975 A1 3/2009 Ditchev
2009/0061991 A1 3/2009 Popovich
2009/0061997 A1 3/2009 Popovich
2009/0061998 A1 3/2009 Popovich
2009/0061999 A1 3/2009 Popovich
2009/0082093 A1 3/2009 Okada

(56) References Cited

U.S. PATENT DOCUMENTS

2009/0088239 A1 4/2009 Iddings
2009/0098934 A1 4/2009 Amour
2009/0118006 A1 5/2009 Kelly et al.
2009/0124344 A1 5/2009 Mitchell et al.
2009/0131158 A1 5/2009 Brunet De Courssou et al.
2009/0131175 A1 5/2009 Kelly et al.
2009/0143141 A1 6/2009 Wells
2009/0149233 A1 6/2009 Strause et al.
2009/0156297 A1 6/2009 Andersson et al.
2009/0176560 A1 7/2009 Herrmann et al.
2009/0176566 A1 7/2009 Kelly
2009/0181777 A1 7/2009 Christiani
2009/0221355 A1 9/2009 Dunaevsky et al.
2009/0239610 A1 9/2009 Olive
2009/0247272 A1 10/2009 Abe
2009/0270164 A1 10/2009 Seelig
2009/0275393 A1 11/2009 Kisenwether
2009/0291755 A1 11/2009 Walker et al.
2009/0309305 A1 12/2009 May
2009/0312093 A1 12/2009 Walker et al.
2009/0325686 A1 12/2009 Davis
2010/0004058 A1 1/2010 Acres
2010/0016056 A1 1/2010 Thomas et al.
2010/0029373 A1 2/2010 Graham et al.
2010/0035674 A1 2/2010 Slomiany
2010/0056247 A1 3/2010 Nicely
2010/0056260 A1 3/2010 Fujimoto
2010/0062836 A1 3/2010 Young
2010/0093420 A1 4/2010 Wright
2010/0093444 A1 4/2010 Biggar et al.
2010/0105454 A1 4/2010 Weber
2010/0120525 A1 5/2010 Baerlocher et al.
2010/0124983 A1 5/2010 Gowin et al.
2010/0137047 A1 6/2010 Englman et al.
2010/0174593 A1 7/2010 Cao
2010/0184509 A1 7/2010 Sylla et al.
2010/0203940 A1 8/2010 Alderucci et al.
2010/0210344 A1 8/2010 Edidin et al.
2010/0227672 A1 9/2010 Amour
2010/0227688 A1 9/2010 Lee
2010/0240436 A1 9/2010 Wilson et al.
2010/0304825 A1 12/2010 Davis
2010/0304839 A1 12/2010 Johnson
2010/0304842 A1 12/2010 Friedman et al.
2011/0009177 A1 1/2011 Katz
2011/0009178 A1 1/2011 Gerson
2011/0045896 A1 2/2011 Sak et al.
2011/0077087 A1 3/2011 Walker et al.
2011/0082571 A1 4/2011 Murdock et al.
2011/0105206 A1 5/2011 Rowe
2011/0107239 A1 5/2011 Adoni
2011/0109454 A1 5/2011 Mcsheffrey
2011/0111820 A1 5/2011 Filipour
2011/0111837 A1 5/2011 Gagner
2011/0111841 A1 5/2011 Tessmer
2011/0118011 A1 5/2011 Filipour et al.
2011/0201413 A1 8/2011 Oberberger
2011/0207523 A1 8/2011 Filipour et al.
2011/0212766 A1 9/2011 Bowers
2011/0212767 A1 9/2011 Barclay
2011/0218028 A1 9/2011 Acres
2011/0218035 A1 9/2011 Thomas
2011/0230258 A1 9/2011 Van Luchene
2011/0230260 A1 9/2011 Morrow et al.
2011/0230267 A1 9/2011 Van Luchene
2011/0244944 A1 10/2011 Baerlocher
2011/0263312 A1 10/2011 De Waal
2011/0269522 A1 11/2011 Nicely et al.
2011/0275440 A1 11/2011 Faktor
2011/0287828 A1 11/2011 Anderson et al.
2011/0287841 A1 11/2011 Watanabe
2011/0312408 A1 12/2011 Okuaki
2011/0319169 A1 12/2011 Lam
2012/0004747 A1 1/2012 Kelly
2012/0028718 A1 2/2012 Barclay et al.
2012/0058814 A1 3/2012 Lutnick
2012/0077569 A1 3/2012 Watkins
2012/0108323 A1 5/2012 Kelly
2012/0135793 A1 5/2012 Antonopoulos
2012/0202587 A1 8/2012 Allen
2012/0302311 A1 11/2012 Luciano
2012/0322545 A1* 12/2012 Arnone ..... G07F 17/3272 463/25
2013/0029760 A1 1/2013 Wickett
2013/0131848 A1 5/2013 Arnone et al.
2013/0190074 A1 7/2013 Arnone et al.
2013/0260869 A1 10/2013 Basallo et al.
2014/0080606 A1* 3/2014 Gillet ..... A63F 13/00 463/35
2014/0087801 A1 3/2014 Nicely et al.
2014/0087808 A1 3/2014 Basallo et al.
2014/0087809 A1 3/2014 Leupp et al.
2014/0357350 A1 12/2014 Weingardt et al.

OTHER PUBLICATIONS

U.S. Appl. No. 14/203,459 Arnone, et al., filed Mar. 10, 2014.
U.S. Appl. No. 14/205,272 Arnone, et al., filed Mar. 11, 2014.
U.S. Appl. No. 13/854,658, Arnone, et al., filed Apr. 1, 2013.
U.S. Appl. No. 13/855,676, Arnone, et al., filed Apr. 2, 2013.
U.S. Appl. No. 13/872,946, Arnone, et al., filed Apr. 29, 2013.
U.S. Appl. No. 13/886,245, Arnone, et al., filed May 2, 2013.
U.S. Appl. No. 13/888,326, Arnone, et al., filed May 6, 2013.
U.S. Appl. No. 13/890,207, Arnone, et al., filed May 8, 2013.
U.S. Appl. No. 13/896,783, Arnone, et al., filed May 17, 2013.
U.S. Appl. No. 13/898,222, Arnone, et al., filed May 20, 2013.
U.S. Appl. No. 13/900,363, Arnone, et al., filed May 22, 2013.
U.S. Appl. No. 13/903,895, Arnone, et al., filed May 28, 2013.
U.S. Appl. No. 13/917,513, Arnone, et al., filed Jun. 13, 2013.
U.S. Appl. No. 13/917,529, Arnone, et al., filed Jun. 13, 2013.
U.S. Appl. No. 13/920,031, Arnone, et al., filed Jun. 17, 2013.
U.S. Appl. No. 13/928,166, Arnone, et al., filed Jun. 26, 2013.
U.S. Appl. No. 13/935,410, Arnone, et al., filed Jul. 3, 2013.
U.S. Appl. No. 13/935,468, Arnone, et al., filed Jul. 3, 2013.
U.S. Appl. No. 13/686,876, Arnone, et al., filed Nov. 27, 2012.
U.S. Appl. No. 13/944,662, Arnone, et al., filed Jul. 17, 2013.
U.S. Appl. No. 13/962,815, Arnone, et al., filed Aug. 8, 2013.
U.S. Appl. No. 13/962,839, Meyerhofer, et al., filed Aug. 8, 2013.
U.S. Appl. No. 14/018,315, Arnone, et al., filed Sep. 4, 2013.
U.S. Appl. No. 14/019,384, Arnone, et al., filed Sep. 5, 2013.
U.S. Appl. No. 14/023,432, Arnone, et al., filed Sep. 10, 2013.
U.S. Appl. No. 13/600,671, Arnone, et al., filed Aug. 31, 2012.
U.S. Appl. No. 13/582,408, Arnone, et al., filed Sep. 26, 2012.
U.S. Appl. No. 13/849,458, Arnone, et al., filed Mar. 22, 2013.
U.S. Appl. No. 14/135,562, Arnone, et al., filed Dec. 19, 2013.
U.S. Appl. No. 14/080,767, Arnone, et al., filed Nov. 14, 2013.
U.S. Appl. No. 14/043,838, Arnone, et al., filed Oct. 1, 2013.
U.S. Appl. No. 14/162,735, Arnone, et al., filed Jan. 23, 2014.
U.S. Appl. No. 14/161,230, Arnone, et al., filed Jan. 22, 2014.
U.S. Appl. No. 14/083,331, Arnone, et al., filed Nov. 18, 2013.
U.S. Appl. No. 14/014,310, Arnone, et al., filed Aug. 29, 2013.
U.S. Appl. No. 14/152,953, Arnone, et al., filed Jan. 10, 2014.
U.S. Appl. No. 14/162,724, Arnone, et al., filed Jan. 23, 2014.
U.S. Appl. No. 14/104,897, Arnone, et al., filed Dec. 12, 2013.
U.S. Appl. No. 14/174,813 Arnone, et al., filed Feb. 6, 2014.
U.S. Appl. No. 14/175,986 Arnone, et al., filed Feb. 7, 2014.
U.S. Appl. No. 14/176,014 Arnone, et al., filed Feb. 7, 2014.
U.S. Appl. No. 14/179,487 Arnone, et al., filed Feb. 12, 2014.
U.S. Appl. No. 14/179,492 Arnone, et al., filed Feb. 12, 2014.
U.S. Appl. No. 14/181,190 Arnone, et al., filed Feb. 14, 2014.
U.S. Appl. No. 14/186,393 Arnone, et al., filed Feb. 21, 2014.
U.S. Appl. No. 14/188,587 Arnone, et al., filed Feb. 24, 2014.
U.S. Appl. No. 14/586,645 Arnone, et al. filed Dec. 30, 2014.
U.S. Appl. No. 14/598,151 Arnone, et al. filed Jan. 15, 2015.
U.S. Appl. No. 14/601,063 Arnone, et al. filed Jan. 20, 2015.
U.S. Appl. No. 14/601,108 Arnone, et al. filed Jan. 20, 2015.
U.S. Appl. No. 14/608,000 Arnone, et al. filed Jan. 28, 2015.
U.S. Appl. No. 14/608,087 Arnone, et al. filed Jan. 28, 2015.
U.S. Appl. No. 14/608,093 Arnone, et al. filed Jan. 28, 2015.

(56) References Cited

OTHER PUBLICATIONS

U.S. Appl. No. 14/610,897 Arnone, et al. filed Jan. 30, 2015.
U.S. Appl. No. 14/611,077 Arnone, et al. filed Jan. 30, 2015.
U.S. Appl. No. 14/604,629 Arnone, et al. filed Jan. 23, 2015.
U.S. Appl. No. 14/625,475 Arnone, et al. filed Feb. 18, 2015.
U.S. Appl. No. 14/617,852 Arnone, et al. filed Feb. 9, 2015.
U.S. Appl. No. 14/627,428 Arnone, et al. filed Feb. 20, 2015.
U.S. Appl. No. 14/642,427 Arnone, et al. filed Mar. 9, 2015.
U.S. Appl. No. 14/665,991 Arnone, et al. filed Mar. 23, 2015.
U.S. Appl. No. 14/666,010 Arnone, et al. filed Mar. 23, 2015.
U.S. Appl. No. 14/666,022 Arnone, et al. filed Mar. 23, 2015.
U.S. Appl. No. 14/642,623 Arnone, et al. filed Mar. 9, 2015.
U.S. Appl. No. 14/663,337 Arnone, et al. filed Mar. 19, 2015.
U.S. Appl. No. 14/666,284 Arnone, et al. filed Mar. 23, 2015.
U.S. Appl. No. 14/679,885 Arnone, et al. filed Apr. 6, 2015.
U.S. Appl. No. 14/685,378 Arnone, et al. filed Apr. 13, 2015.
U.S. Appl. No. 14/686,675 Arnone, et al. filed Apr. 14, 2015.
U.S. Appl. No. 14/686,678 Arnone, et al. filed Apr. 14, 2015.
U.S. Appl. No. 14/701,430 Arnone, et al. filed Apr. 30, 2015.
U.S. Appl. No. 14/703,721 Arnone, et al. filed May 4, 2015.
U.S. Appl. No. 14/708,138 Arnone, et al. filed May 8, 2015.
U.S. Appl. No. 14/708,141 Arnone, et al. filed May 8, 2015.
U.S. Appl. No. 14/708,160 Arnone, et al. filed May 8, 2015.
U.S. Appl. No. 14/708,161 Arnone, et al. filed May 8, 2015.
U.S. Appl. No. 14/708,162 Arnone, et al. filed May 8, 2015.
U.S. Appl. No. 14/710,483 Arnone, et al. filed May 12, 2015.
U.S. Appl. No. 14/714,084 Arnone, et al. filed May 15, 2015.
U.S. Appl. No. 14/715,463 Arnone, et al. filed May 18, 2015.
U.S. Appl. No. 14/720,620 Arnone, et al. filed May 22, 2015.
U.S. Appl. No. 14/720,624 Arnone, et al. filed May 22, 2015.
U.S. Appl. No. 14/720,626 Arnone, et al. filed May 22, 2015.
U.S. Appl. No. 14/727,726 Arnone, et al. filed Jun. 1, 2015.
U.S. Appl. No. 14/730,183 Arnone, et al. filed Jun. 3, 2015.
U.S. Appl. No. 14/731,321 Arnone, et al. filed Jun. 4, 2015.
U.S. Appl. No. 14/740,078 Arnone, et al. filed Jun. 15, 2015.
U.S. Appl. No. 14/742,517 Arnone, et al. filed Jun. 17, 2015.
U.S. Appl. No. 14/743,708 Arnone, et al. filed Jun. 18, 2015.
U.S. Appl. No. 14/746,731 Arnone, et al. filed Jun. 22, 2015.
U.S. Appl. No. 14/748,122 Arnone, et al. filed Jun. 23, 2015.
U.S. Appl. No. 14/788,581 Arnone, et al. filed Jun. 30, 2015.
U.S. Appl. No. 14/793,685 Arnone, et al. filed Jul. 7, 2015.
U.S. Appl. No. 14/793,704 Arnone, et al. filed Jul. 7, 2015.
U.S. Appl. No. 14/797,016 Arnone, et al. filed Jul. 10, 2015.
U.S. Appl. No. 14/799,481 Arnone, et al. filed Jul. 14, 2015.
U.S. Appl. No. 14/205,303 Arnone, et al., filed Mar. 11, 2014.
U.S. Appl. No. 14/205,306 Arnone, et al., filed Mar. 11, 2014.
U.S. Appl. No. 14/209,485 Arnone, et al., filed Mar. 13, 2014.
U.S. Appl. No. 14/214,310 Arnone, et al., filed Mar. 14, 2014.
U.S. Appl. No. 14/222,520 Arnone, et al., filed Mar. 21, 2014.
U.S. Appl. No. 14/253,813 Arnone, et al., filed Apr. 15, 2014.
U.S. Appl. No. 14/255,253 Arnone, et al., filed Apr. 17, 2014.
U.S. Appl. No. 14/255,919 Arnone, et al. filed Apr. 17, 2014.
U.S. Appl. No. 14/263,988 Arnone, et al. filed Apr. 28, 2014.
U.S. Appl. No. 14/270,335 Arnone, et al. filed May 5, 2014.
U.S. Appl. No. 14/271,360 Arnone, et al. filed May 6, 2014.
U.S. Appl. No. 13/961,849 Arnone, et al. filed Aug. 7, 2013.
U.S. Appl. No. 13/746,850 Arnone, et al. filed Jan. 22, 2013.
U.S. Appl. No. 14/288,169 Arnone, et al. filed May 27, 2014.
U.S. Appl. No. 14/304,027 Arnone, et al. filed Jun. 13, 2014.
U.S. Appl. No. 14/306,187 Arnone, et al. filed Jun. 16, 2014.
U.S. Appl. No. 14/312,623 Arnone, et al. filed Jun. 23, 2014.
U.S. Appl. No. 14/330,249 Arnone, et al. filed Jul. 14, 2014.
U.S. Appl. No. 14/339,142 Arnone, et al. filed Jul. 23, 2014.
U.S. Appl. No. 14/458,206 Arnone, et al. filed Aug. 12, 2014.
U.S. Appl. No. 14/461,344 Arnone, et al. filed Aug. 15, 2014.
U.S. Appl. No. 14/462,516 Arnone, et al. filed Aug. 18, 2014.
U.S. Appl. No. 14/467,646 Meyerhofer, et al. filed Aug. 25, 2014.
U.S. Appl. No. 14/474,023 Arnone, et al. filed Aug. 29, 2014.
U.S. Appl. No. 14/486,895 Arnone, et al. filed Sep. 15, 2014.
U.S. Appl. No. 14/507,206 Arnone, et al. filed Oct. 6, 2014.
U.S. Appl. No. 14/521,338 Arnone, et al. filed Oct. 22, 2014.
U.S. Appl. No. 14/535,808 Arnone, et al. filed Nov. 7, 2014.
U.S. Appl. No. 14/535,816 Arnone, et al. filed Nov. 7, 2014.
U.S. Appl. No. 14/536,231 Arnone, et al. filed Nov. 7, 2014.
U.S. Appl. No. 14/536,280 Arnone, et al. filed Nov. 7, 2014.
U.S. Appl. No. 14/549,137 Arnone, et al. filed Nov. 20, 2014.
U.S. Appl. No. 14/550,802 Arnone, et al. filed Nov. 21, 2014.
U.S. Appl. No. 14/555,401 Arnone, et al. filed Nov. 26, 2014.
U.S. Appl. No. 14/559,840 Arnone, et al. filed Dec. 3, 2014.
U.S. Appl. No. 14/564,834 Arnone, et al. filed Dec. 9, 2014.
U.S. Appl. No. 14/570,746 Arnone, et al. filed Dec. 15, 2014.
U.S. Appl. No. 14/570,857 Arnone, et al. filed Dec. 15, 2014.
U.S. Appl. No. 14/586,626 Arnone, et al. filed Dec. 30, 2014.
U.S. Appl. No. 14/586,639 Arnone, et al. filed Dec. 30, 2014.
U.S. Appl. No. 14/815,764 Arnone, et al. filed Jul. 31, 2015.
U.S. Appl. No. 14/815,774 Arnone, et al. filed Jul. 31, 2015.
U.S. Appl. No. 14/817,032 Arnone, et al. filed Aug. 3, 2015.
U.S. Appl. No. 14/822,890 Arnone, et al. filed Aug. 10, 2015.
U.S. Appl. No. 14/823,951 Arnone, et al. filed Aug. 11, 2015.
U.S. Appl. No. 14/823,987 Arnone, et al. filed Aug. 11, 2015.
U.S. Appl. No. 14/825,056 Arnone, et al. filed Aug. 12, 2015.
U.S. Appl. No. 14/835,590 Arnone, et al. filed Aug. 25, 2015.
U.S. Appl. No. 14/836,902 Arnone, et al. filed Aug. 26, 2015.
U.S. Appl. No. 14/839,647 Arnone, et al. filed Aug. 28, 2015.
U.S. Appl. No. 14/842,684 Arnone, et al. filed Sep. 1, 2015.
U.S. Appl. No. 14/842,785 Arnone, et al. filed Sep. 1, 2015.
U.S. Appl. No. 14/854,021 Arnone, et al. filed Sep. 14, 2015.
U.S. Appl. No. 14/859,065 Arnone, et al. filed Sep. 18, 2015.
U.S. Appl. No. 14/865,422 Arnone, et al. filed Sep. 25, 2015.
WIPO/IPEA International Preliminary Report on Patentability, PCT/US14/31519, dated Aug. 15, 2014.

* cited by examiner

GAME WORLD SERVER DRIVEN TRIGGERING FOR GAMBLING HYBRID GAMING SYSTEM

CROSS-REFERENCE TO RELATED APPLICATIONS

The current application is a continuation of Patent Cooperation Treaty Application No. PCT/US14/31519, filed Mar. 21, 2014, which claims the benefit of U.S. Provisional Application No. 61/805,878, filed Mar. 27, 2013, the disclosure of which is incorporated by reference as if set forth herewith. The current application references PCT Applications: PCT/US11/26768 filed Mar. 1, 2011; PCT/US11/63587 filed Dec. 6, 2011; PCT/US12/32652 filed Apr. 7, 2012; PCT/US12/40548 filed Jun. 1, 2012; and USPCT/US12/40800 filed Jun. 4, 2012, the disclosures of which are incorporated by reference as if set forth herewith.

FIELD OF THE INVENTION

Embodiments of the present invention are generally related to gaming and more specifically to systems and processes that provide triggering of a gambling event in a gambling game based upon a game state of an entertainment game represented by one of more entertainment game variables in a gambling hybrid game.

BACKGROUND

The gaming machine manufacturing industry provides a variety of gaming machines to enable wagering for interested parties whilst providing an entertainment experience. An exemplary gaming machine is a slot machine. As the demographic of eligible players has shifted with time to newer generations who have grown accustomed to highly sophisticated graphics and interactive video games, a need has arisen to increase the entertainment content present on a gaming machine to keep it relevant, at least to a growing portion of a casino's patronage. The subject design is a form of gaming machine, designed for use in a physical or virtual casino environment, which provides players an environment in which to play for cash, prizes and points, either against the casino or in head to head modes in a controlled and regulated manner while being allowed to use their skills and adeptness at a particular type of game. An example of such a game would be a challenging word spelling game, or an interactive action game such as is found on video game consoles popular today, such as a PlayStation®, an Xbox®, a Wii® or a PC based game.

SUMMARY OF THE INVENTION

The disclosed embodiments relate generally to an interactive entertainment game where skill and chance may coalesce to provide a rich arcade-style gaming experience, visually exciting and challenging, where players may wager cash, credits prizes and points in order to win more of the foregoing. Many of the embodiments of the design provide an enticing method of gaming to the players who expect a high level of entertainment content in their gaming experience compared to the relatively simple game methods in use today.

In accordance with embodiments of this invention, a gaming system for providing a gambling hybrid game that includes an entertainment game and a gambling game, includes a processing device constructed to execute the entertainment game, where the entertainment game updates a value for each entertainment game variable in a set of entertainment game variables and the set of entertainment game variables represents a state of the entertainment game, including at least one entertainment game variable, communicate, to a game world server, a signal including a trigger of a wager based on the player's action during the player's skillful play of the entertainment game, receive, from the game world server, a signal including a result of the wager triggered based on the player's action during the player's skillful play of the entertainment game, display the result of the wager triggered based on the player's action during the player's skillful play of the entertainment game, communicate, to the game world server, a signal including the value for each entertainment game variable in the set of entertainment game variables, and receive, from the game world server, a signal including a change in the set of entertainment game variables.

In accordance with embodiments of this invention, a gaming system for providing a gambling hybrid game that includes an entertainment game and a gambling game, further includes a real world server constructed to receive, from the game world server, the signal including the trigger of the wager based on the player's action during the player's skillful play of the entertainment game, determine the result of the wager triggered based on the player's action during the player's skillful play of the entertainment game, communicate, to the game world server, the signal including the result of the wager triggered based on the player's action during the player's skillful play of the entertainment game, receive, from the game world server, a signal including a trigger to resolve the wager based upon the signal including the value for each entertainment game variable in the set of entertainment game variables, determine a result of the wager based upon the signal including the value for each entertainment game variable in the set of entertainment game variables, and communicate, to the game world server, the result of the wager based upon the signal including the value for each entertainment game variable in the set of entertainment game variables.

In accordance with embodiments of this invention, a gaming system for providing a gambling hybrid game that includes an entertainment game and a gambling game, further includes the game world server, connected to the processing device via a network and connected to the real world server via a communication link, constructed to continuously monitor the processing device for the signal including the trigger of the wager based on the player's action during the player's skillful play of the entertainment game, receive, from the processing device, the signal including the trigger of the wager based on the player's action during the player's skillful play of the entertainment game, communicate, to the real world server, the signal including the trigger of the wager based on the player's action during the player's skillful play of the entertainment game, receive, from the real world server, the signal including the result of the wager triggered based on the player's action during the player's skillful play of the entertainment game, communicate, to the processing device, the signal including the result of the wager triggered based on the player's action during the player's skillful play of the entertainment game, receive, from the processing device, the signal including the value for each entertainment game variable in the set of entertainment game variables, determine a wager in the gambling game is triggered based upon the signal including the value for each entertainment game variable in the set of entertainment game variables, communicate, to the real world server, the signal including the trigger to resolve the wager based upon the signal including the value for each entertainment game variable in the set of entertainment game variables, receive, from the real world server, the result of the wager based upon the signal including the value for each entertainment game variable in the set of entertainment game variables, determine the change to the set of entertainment game variables based upon the result of the wager based upon the signal including the value for each entertainment game variable in the set of entertainment game variables, and communicate, to the processing device, the signal including the change to the set of entertainment game variables.

In accordance with various embodiments, the game world server is further constructed to determine an amount of Quanta to provide based upon the result of the wager.

In accordance with many embodiments, one variable in the set of entertainment game variables is a discrete variable and Boolean logic is used to determine whether the wager is triggered based on the discrete variable.

In accordance with numerous embodiments, one variable in the set of entertainment game variables is a continuous variable and the determination of whether the wager is triggered is based upon a comparison of the value of the continuous variable to a threshold value.

In accordance with various embodiments, one variable in the set of entertainment game variables is a continuous variable and the determination of whether the wager is triggered is based upon a first derivative of the continuous variable.

In accordance with many embodiments, one variable in the set of entertainment game variables is a continuous variable and the determination of whether the wager is triggered is based upon a second derivative of the continuous variable.

DETAILED DISCLOSURE OF THE INVENTION

Turning now to the drawings, systems and methods for providing a gambling hybrid game with game world engine triggered gambling events in accordance with embodiments of the invention are disclosed. In accordance with many embodiments of the invention, a gambling hybrid game includes an entertainment system engine that executes an entertainment game, a real world engine that determines a result of a gambling event, and a game world engine that manages the entertainment game, determines when a gambling event occurs in the entertainment game, and requests that the gambling event be resolved by the real world engine. In accordance with some embodiments of the invention, the entertainment engine provides entertainment game variables that represent the current game state of the entertainment game. The game world engine uses the entertainment game variables as inputs to functions that determine whether to trigger a gambling event in a gambling game. Thus, the current game state of the entertainment game as represented by the entertainment game variables determines whether a gambling event is triggered instead of an occurrence of a triggering event during game play of an entertainment game in a gambling hybrid game. Hence, the triggering of gambling events is abstracted as not to rely on specific occurrences of events in the entertainment game.

Systems and methods for providing a gambling hybrid game in which gambling events are triggered by the game world engine based upon the entertainment game variables in accordance with embodiments of this invention are described below with reference to the provided drawings.

Gambling Hybrid Games

Figure 1:
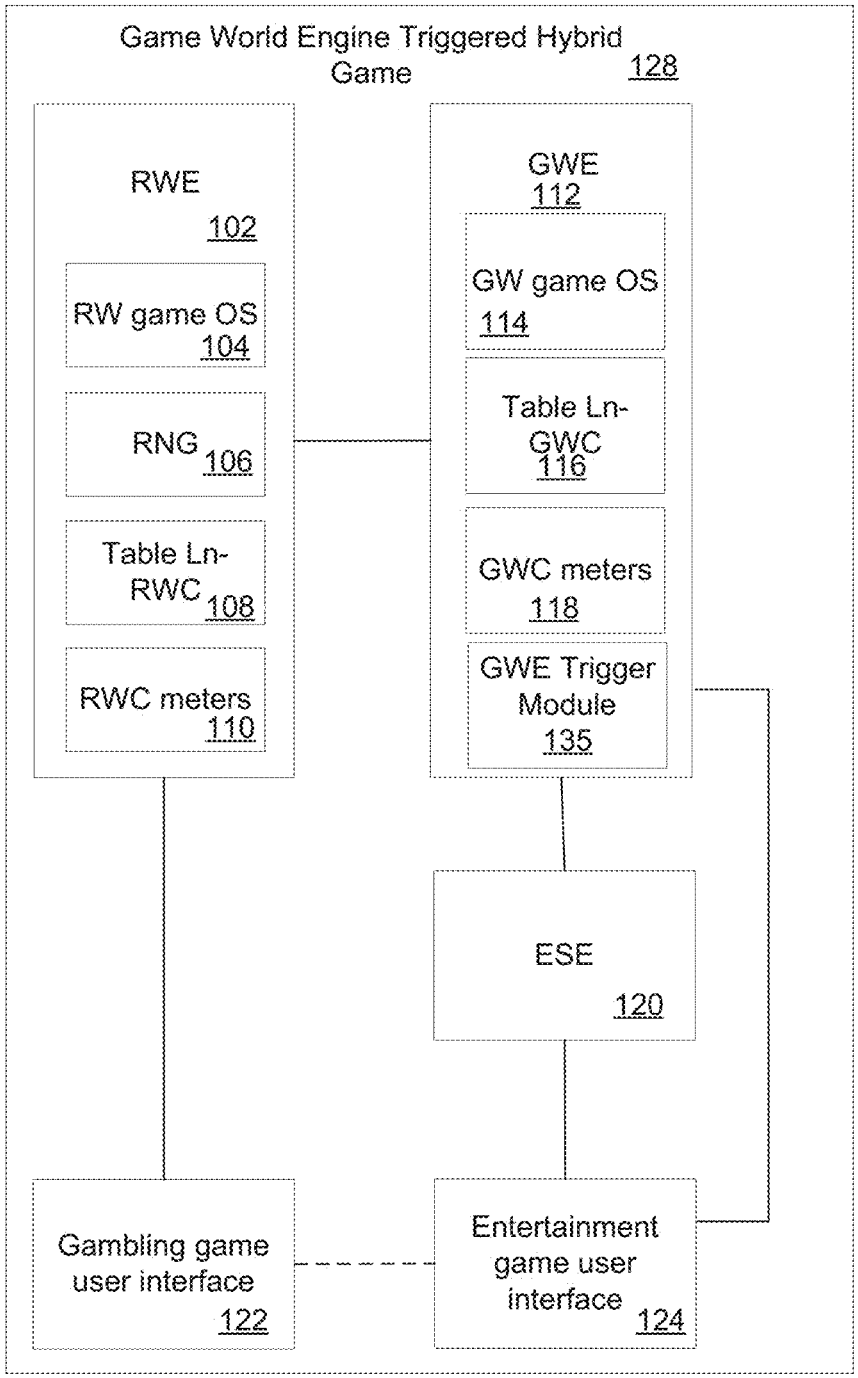
FIG. 1 illustrates a conceptual diagram of components of a gambling hybrid game in accordance with an embodiment of the invention.

In accordance with many embodiments of this invention, a gambling hybrid game integrates high-levels of entertainment content with a game of skill (an entertainment game) and a gambling experience with a game of chance (a gambling game). A gambling hybrid game provides for random wagering or gambling outcomes independent of player skill while providing that the user's gaming experience (as measured by obstacles/challenges encountered, time of play and other factors) is shaped by the player's skill. The outcome of a gambling proposition that is determined by a Pseudo Random or Random Number Generator (P/RNG) or other such device that provides a random outcome in response to a request. In accordance with some embodiments, the wager game may be initiated in response to a game object related player action. A gambling hybrid game in accordance with an embodiment of the invention is illustrated in FIG. 1. The gambling hybrid game 128 includes a Real World Engine (RWE) 102, a Game World Engine (GWE) 112, an Entertainment System Engine (ESE) 120, a gambling game user interface 122 and an entertainment game user interface 124. The two user interfaces may be part of the same user interface but are separate in the illustrated embodiment. The RWE 102 is connected with the GWE 112 and the gambling game user interface 122. The ESE 120 is connected with the GWE 112 and the entertainment game user interface 124. The GWE 112 is connected also with the entertainment game user interface 124.

In accordance with several embodiments, the RWE 102 is the operating system for the gambling game of the gambling hybrid game 128 and controls and operates the gambling game. The operation of a gambling game is enabled by Real World Currency (RC), such as money or other real world funds. A gambling game can increase or decrease an amount of RC based on random gambling outcomes, where the gambling proposition of a gambling game is typically regulated by gaming control bodies. In many embodiments, the RWE 102 includes a Real World (RW) operating system (OS) 104, P/RNG 106, level n real-world credit pay tables (Table Ln-RC) 108, RC meters 110 and other software constructs that enable a game of chance to offer a fair and transparent gambling proposition, and to contain the auditable systems and functions that can enable the game to obtain gaming regulatory body approval.

A pseudo random or random number generator (P/RNG) 106 includes software and/or hardware algorithms and/or processes, which are used to generate pseudo random or random outcomes. A level n real-world credit pay table (Table Ln-RC) 108 is a table that may be used in conjunction with P/RNG 106 to dictate the RC earned as a function of sponsored gameplay and is analogous to the pay tables used in a conventional slot machine. Table Ln-RC payouts are independent of player skill. There may be one table or multiple tables included in Ln-RC pay tables 108 contained in a gambling game, the selection of which may be determined by factors including (but not limited to) game progress that a player has earned, and/or bonus rounds for which a player may be eligible. RCs are credits analogous to slot machine game credits, which are entered into a gambling game by the user, either in the form of money such as hard currency or electronic funds. RCs may be decremented or augmented based on the outcome of a P/RNG according to the table Ln-RC real world credits pay table 108, independent of player skill. In certain embodiments, an amount of RC may be used as criteria in order to enter higher ESE game levels. RC may be carried forward to higher game levels or paid out if a cash out is opted for by a player. The amount of RC used to enter a specific level of the game, level n, need not be the same for each level.

In accordance with some embodiments of this invention, the GWE 112 manages the overall gambling hybrid game operation, with the RWE 102 and the ESE 120 effectively being support units to the GWE 112. In accordance with some of these embodiments, the GWE 112 contains mechanical, electronic, and software systems for an entertainment game. The GWE 112 includes an Operating System (OS) 114 that provides control of the entertainment game. The GWE additionally contains a level n game world credit pay table (table Ln-GWC) 116 from where to take input from this table to affect the play of the entertainment game. The GWE 112 can further couple to the RWE 102 to determine the amount of RC available on the game and other metrics of wagering on the gambling game (and potentially affect the amount of RC in play on the RWE). The GWE additionally contains various audit logs and activity meters (such as the GWC meter) 118. The GWE 112 can also couple to a centralized server for exchanging various data related to the player and his or her activities in the game. The GWE 112 furthermore couples to the ESE 120.

In accordance with some embodiments, a level n game world credit pay table (Table Ln-GWC) 116 dictates the Game World Credit (GWC) earned as a function of player skill in the nth level of the game. The payouts governed by this table are dependent upon player skill and sponsored gameplay at large and can or cannot be coupled to a P/RNG. In accordance with some embodiments, GWCs are player points earned or depleted as a function of player skill, specifically as a function of player performance in the context of the entertainment game. GWC is analogous to the score in a typical video game. Each entertainment game has one or more scoring criterion, embedded within the table Ln-GWC 116 that reflects player performance against the goal(s) of the game. GWCs may be carried forward from one level of sponsored gameplay to another, and ultimately paid out in various manners such as directly in cash, or indirectly such as by earning entrance into a sweepstakes drawing, or earning participation in, or victory in, a tournament with prizes. GWCs may be stored on a player tracking card or in a network-based player tracking system, where the GWCs are attributed to a specific player.

In accordance with certain embodiments, the operation of the GWE does not affect the RWE's gambling operation except for player choice parameters that are allowable in slot machines, including but not limited to, wager terms such as, but not limited to, a wager amount, how fast the player wants to play (by pressing a button or pulling the handle of a slot machine), and/or agreement to wager into a bonus round. In this sense, the RWE 102 provides a fair and transparent, non-skill based gambling proposition co-processor to the GWE 112. In the illustrated embodiment, the communication link shown between the GWE 112 and the RWE 102 allows the GWE 112 to obtain information from the RWE 102 as to the amount of RC available in the gambling game. The communication link can also convey a status operation of the RWE (such as on-line or tilt). The communication link can further communicate the various gambling control factors which the RWE 102 uses as input, such as the number of RC consumed per game or the player's election to enter a jackpot round. In FIG. 1, the GWE 112 is also shown as connecting to the player's user interface directly, as this may be utilized to communicate certain entertainment game club points, player status, control the selection of choices and messages which a player can find useful in order to adjust the entertainment game experience or understand their gambling status in the RWE 102.

In some embodiments, the GWE includes a GWE trigger module 135 that implements one or more features of a game world engine triggered hybrid game as described herein.

In accordance with various embodiments of this invention, the ESE 120 manages and controls the visual, audio, and player control for the entertainment game. In accordance with certain embodiments, the ESE 120 accepts input from a player through a set of hand controls, and/or head, gesture, and/or eye tracking systems and outputs video, audio and/or other sensory output to a user interface. In accordance with many embodiments, the ESE 120 can exchange data with and accept control information from the GWE 112. In accordance with some of these embodiments, an ESE 120 may be implemented using a Personal Computer (PC), a Sony PlayStation® (a video game console developed by Sony Computer Entertainment of Tokyo Japan), or Microsoft Xbox® (a video game console developed by Microsoft Corporation of Redmond, Wash.) running a specific entertainment game software program. In accordance with some of these embodiments, ESE 120 may be an electromechanical game system of a gambling hybrid game that is an electromechanical hybrid game. An electromechanical hybrid game executes an electromechanical game for player entertainment. The electromechanical game may be any game that utilizes both mechanical and electrical components, where the game operates as a combination of mechanical motions performed by at least one player or the electromechanical game itself. Various electromechanical hybrid games are discussed in Patent Cooperation Treaty Application No. PCT/US12/58156, filed Sep. 29, 2012, the contents of which are hereby incorporated by reference in their entirety.

The ESE 120 operates mostly independently from the GWE 112, except that via the interface, the GWE 112 can send certain entertainment game control parameters and elements to the ESE 120 to affect its play, such as (but not limited to) what level of character to be using, changing the difficulty level of the game, changing the type of gun or car in use, and/or requesting portions to become available or to be found by the character. These game control parameters and elements may be based on a gambling outcome of a gambling game that was triggered by an element in the entertainment game being acted upon by the player. The ESE 120 can accept this input from the GWE 112, make adjustments, and continue entertainment game gameplay all the while running seamlessly from the player's perspective. The ESE's operation is mostly skill based, except for where the ESE's processes can inject complexities into the game by chance in its normal operation to create unpredictability in the entertainment game. Utilizing this interface, the ESE 120 can also communicate player choices made in the game to the GWE 112, such as but not limited to selection of a different gun, and/or the player picking up a special portion in the GW environment. The GWE's function in this architecture, being interfaced with the ESE 120, is to allow the transparent coupling of entertainment software to a fair and transparent random chance gambling game, providing a seamless perspective to the player that they are playing a typical popular entertainment game (which is skill based). In accordance with certain embodiments, the ESE 120 may be used to enable a wide range of entertainment games including but not limited to popular titles from arcade and home video games, such as but not limited to Gears of War (a third person shooter game developed by Epic Games of Cary, N.C.), Time Crisis (a shooter arcade game developed by Namco Ltd of Tokyo, Japan), or Madden Football (an American football video game developed by EA Tiburon of Maitland, Fla.). Providers of such software can provide the previously described interface by which the GWE 120 can request amendments to the operation of the ESE software in order to provide seamless and sensible operation as both a gambling game and an entertainment game.

In accordance with some embodiments, the RWE 102 can accept a trigger to run a gambling game in response to actions taken by the player in the entertainment game as conveyed by the ESE 120 to the GWE 112, or as triggered by the GWE 112 based on its algorithms, background to the overall game from the player's perspective, but can provide information to the GWE 112 to expose the player to certain aspects of the gambling game, such as (but not limited to) odds, amount of RC in play, and amount of RC available. The RWE 102 can accept modifications in the amount of RC wagered on each individual gambling try, or the number of gambling games per minute the RWE 102 can execute, entrance into a bonus round, and other factors, all the while these factors can take a different form than that of a typical slot machine. An example of a varying wager amount that the player can choose can include, but is not limited to, gameplay with a more powerful character, a more powerful gun, or a better car. These choices can increase or decrease the amount wagered per individual gambling game, in the same manner that a standard slot machine player can decide to wager more or less credits for each pull of the handle. In accordance with some of these embodiments, the RWE 102 can communicate a number of factors back and forth to the GWE 112, via an interface, such increase/decrease in wager being a function of the player's decision making as to their operational profile in the entertainment game (such as but not limited to the power of the character, gun selection or car choice). In this manner, the player is always in control of the per game wager amount, with the choice mapping to some parameter or component that is applicable to the entertainment game experience of the hybrid game. In accordance with a particular embodiment, the RWE 102 operation may be a game of chance as a gambling game running every 10 seconds where the amount wagered is communicated from the GWE 112 as a function of choices the player makes in the operation profile in the entertainment game.

In many embodiments, a gambling hybrid game integrates a video game style gambling machine, where the gambling game (including an RWE 102 and RC) is not player skill based, while at the same time allows players to use their skills to earn club points which a casino operator can translate to rewards, tournament opportunities and prizes for the players. The actual exchange of monetary funds earned or lost directly from gambling against a game of chance in a gambling game, such as a slot machine, is preserved. At the same time, a rich environment of rewards to stimulate gamers may be established with the entertainment game. In accordance with some of these embodiments, the gambling hybrid game can leverage very popular titles with gamers and provides a sea change environment for casinos to attract players with games that are more akin to the type of entertainment that a younger generation desires. In accordance with various embodiments, players can use their skill towards building and banking Game World Credit (GWC) that in turn may be used to win tournaments and various prizes as a function of their gamer prowess. Numerous embodiments minimize the underlying changes needed to the aforementioned entertainment software for the hybrid game to operate within an entertainment game construct, thus making a plethora of complex game titles and environments, rapid and inexpensive to deploy in a gambling environment.

In accordance with some embodiments, gambling hybrid games also allow players to gain entry into subsequent competitions through the accumulation of Game World Credits (GWC) as a function of the user's demonstrated skill at the game. These competitions can pit individual players or groups of players against one another and/or against the casino to win prizes based upon a combination of chance and skill. These competitions may be either asynchronous events, whereby players participate at a time and/or place of their choosing, or they may be synchronized events, whereby players participate at a specific time and/or venue.

In accordance with some embodiments, one or more players engage in playing an entertainment game, resident in the ESE, the outcomes of which are dependent at least in part on skill. The gambling hybrid game can include an entertainment game that includes head to head play between a single player and the computer, between two or more players against one another, or multiple players playing against the computer and/or each other, as well as the process by which players bet on the outcome of the entertainment game. The entertainment game can also be a game where the player is not playing against the computer or any other player, such as in games where the player is effectively playing against himself or herself (such as but not limited to Solitaire and Babette).

In accordance with some embodiments, the use of the RWE, GWE and ESE allows for the separation of control of a gambling hybrid game between different devices. For example, the ESE may be hosted by a device that is separate from any devices that host the RWE and/or GWE. Through separation of control of the functions of the ESE, RWE and GWE, the RWE may be isolated from the player's device, thus preventing player interference with the RWE and the gambling game. In addition, as the ESE is responsible for providing the entertainment game, gambling hybrid games may provide for complex entertainment games for the player as the ESE need not include the tightly regulated components of the RWE, thus providing for more freedom in ESE design. Also, separation of control allows a GWE to provide complex wager initiation rules that would not be possible if the either the ESE or the RWE were to be in control of the wager initiation.

In accordance with various embodiments, a gambling hybrid game allows for interleaving of continuous wagering within an entertainment game. For example, instead of wagering once, and then playing an entertainment game to completion, or playing an entertainment game to completion and then placing a wager, a gambling hybrid game allows a gaming system or device to be provided to a player where the gaming system or device provides a complex and interesting entertainment game with wagering incorporated throughout the entertainment game.

In various embodiments, a gambling hybrid game provides for feedback into the entertainment game of additional entertainment game resources that are made available in the ESE for the use of the player as the result of wagering outcomes. The additional entertainment game resources may enable portions of the entertainment game that were not available to the player without the resources.

In many embodiments, a gambling hybrid game provides the ability to use the gambling hybrid game in more than one jurisdiction, as the ESE is a component separate from the GWE and RWE. For example, the ESE may be operated as either a pure entertainment game, or as a gambling game depending on the type of characteristics of the RWE that the ESE is coupled to.

In some embodiments, a gambling hybrid game provides for display of an entertainment game on a player's device that the player is using to interact with the entertainment game, as well as providing a separate display of a state of a gambling game on a separate gambling game display. The separate gambling game display may be on the player's device within the same physical display device, on a separate device having a separate physical screen, or on a separate physical display device on the player's device.

Figure 2:
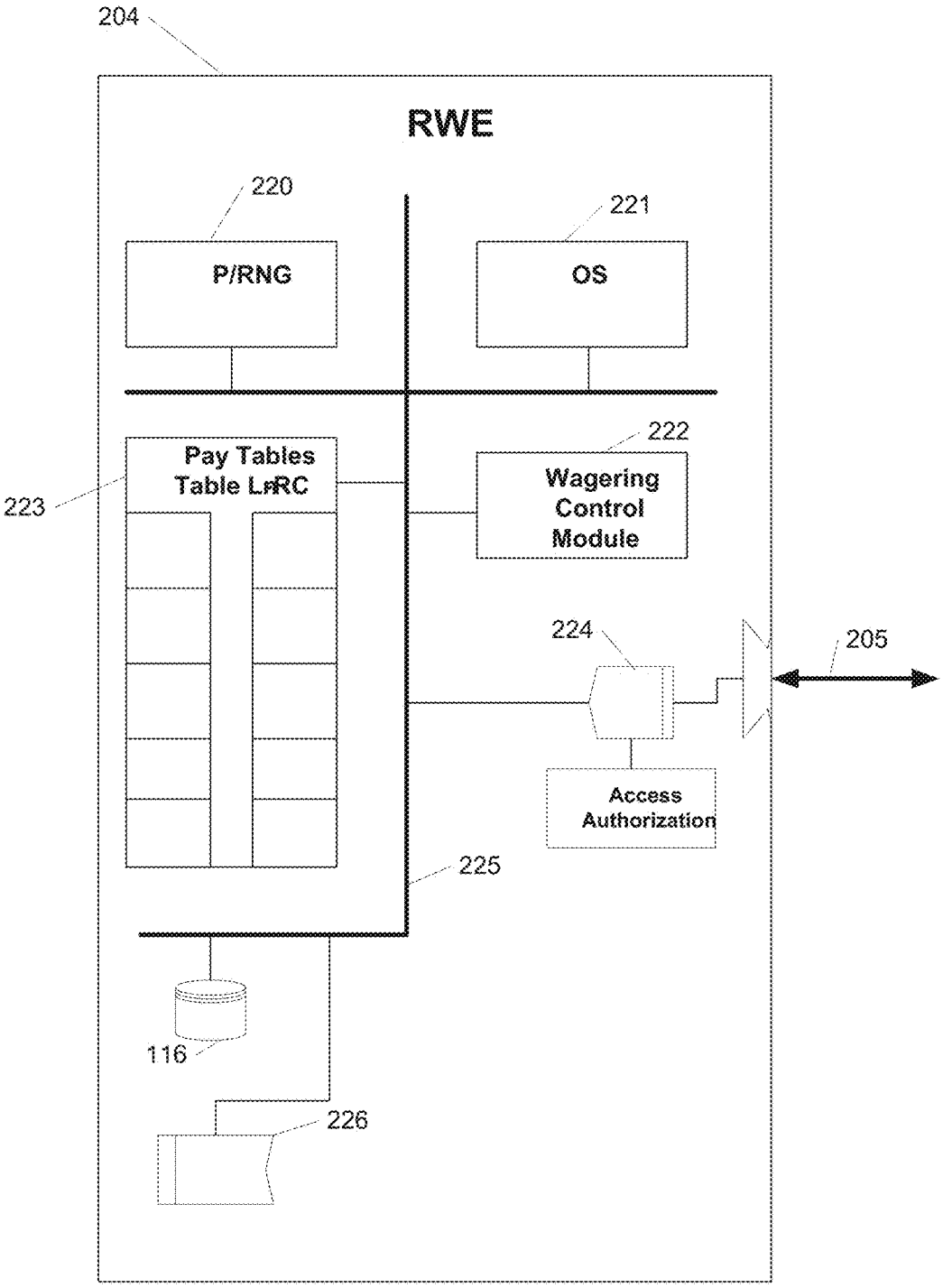
FIG. 2 illustrates a conceptual diagram of aspects of a Real World Engine (RWE) of a gambling hybrid game in accordance with some embodiments of the invention.

The components provided by the RWE for a gambling hybrid game in accordance with embodiments of the invention are shown in FIG. 2. In accordance with embodiments of the invention, the RWE includes an internal bus 225 that connects an operating system OS 221, a Pseudo Random or Random Number Generator (P/RNG) 220, one or more pay tables (Table Ln-RC) 223, a wagering control module 222, an authorization access module 224, and a RC credit meter 226 that are included in the RWE 204. The RW OS 221 controls the functions of the RWE 204. The P/RNG 220 includes one or more P/RNGs that are used to produce pseudo random or random numbers for use in resolving gambling events and other process requiring a random number to determine an outcome. The one or more pay tables (Table Ln-RC) 223 control the functions of the RWE and contain a plurality of factors indexed by the pseudo random or random number to be multiplied with the RC wagered to determine the payout on a successful wager. A wagering control module 222 performs the processes to resolve a wager on a proposition of a gambling event. The resolution process includes, but is not limited to, pulling pseudo random or random numbers, looking up factors in pay tables, multiplying the factors by the amount of RC wagered, and administering a RC credit meter 226. A repository (a credit meter) 226 maintains a record of the amount of RC which a player has deposited in the game and has been accumulated by the player.

An external connection allows the RWE 204 to interface to another system or device, which is shown in FIG. 2 as the Internet 205 but may be any other network and/or device. The authorization access module 224 of RWE 204 is connected to the external connection and provides a method to permit access and command exchange between an external system and the RWE 204. The RWE 204 also contains storage for statuses, wagers, wager outcomes, meters and other historical events in a storage device 116.

Figure 3:
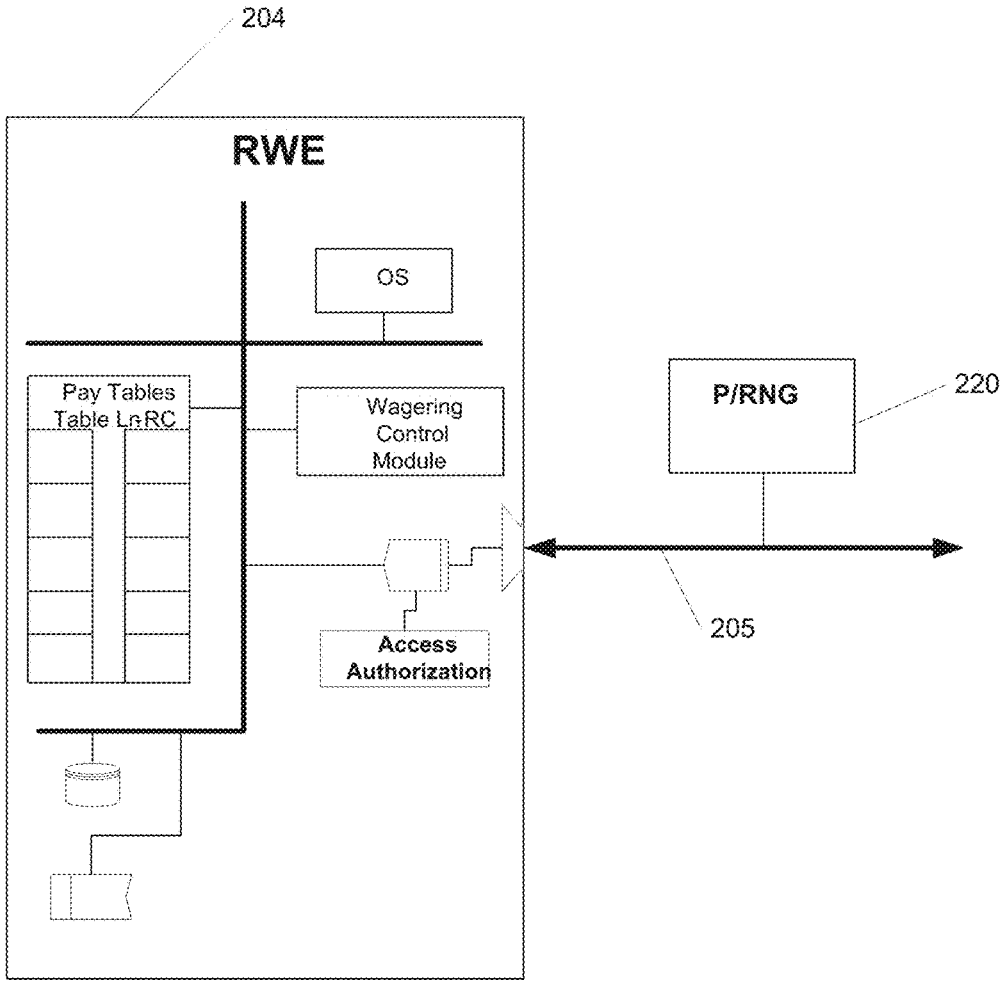
FIG. 3 illustrates a conceptual diagram of aspects of a Real World Engine (RWE) of a gambling hybrid game in accordance with some other embodiments of the invention.

In some embodiments, the RWE 204 communicates with external systems to provide various functions of a gambling hybrid game in accordance with embodiments of the invention. The components of an RWE 204 that communicate with an external system to provide a component of the RWE 204 in accordance with embodiments of the invention are shown in FIG. 3. The RWE 204 shown in FIG. 3 is similar to the RWE shown in FIG. 2. However, the P/RNG 220 is an external system connected to the RWE 204 by the Internet 205 in accordance with embodiments of the invention. The P/RNG 220 could be a central deterministic system, such as a regulated and controlled random numbered ball selection device, or some other system which provides random or pseudo random numbers to one or a plurality of connected RWEs 204. One skilled in the art will recognize that only P/RNG 220 is an external system in the embodiment illustrated in FIG. 3. However, any of the components could be external systems without departing from the invention and P/RNG 220 is shown as an example only.

In FIGS. 2 and 3, the RWE 204 interfaces with other systems/devices or to an external P/RNG 220 using the Internet 205. However, one skilled in the art will note that nothing would preclude using a different interface than the Internet 205 in other embodiments of the invention. Other examples of interfaces include, but are not limited to, a LAN, a USB interface, or some other method by which two electronic and software constructs could communicate with each other.

Figure 4:
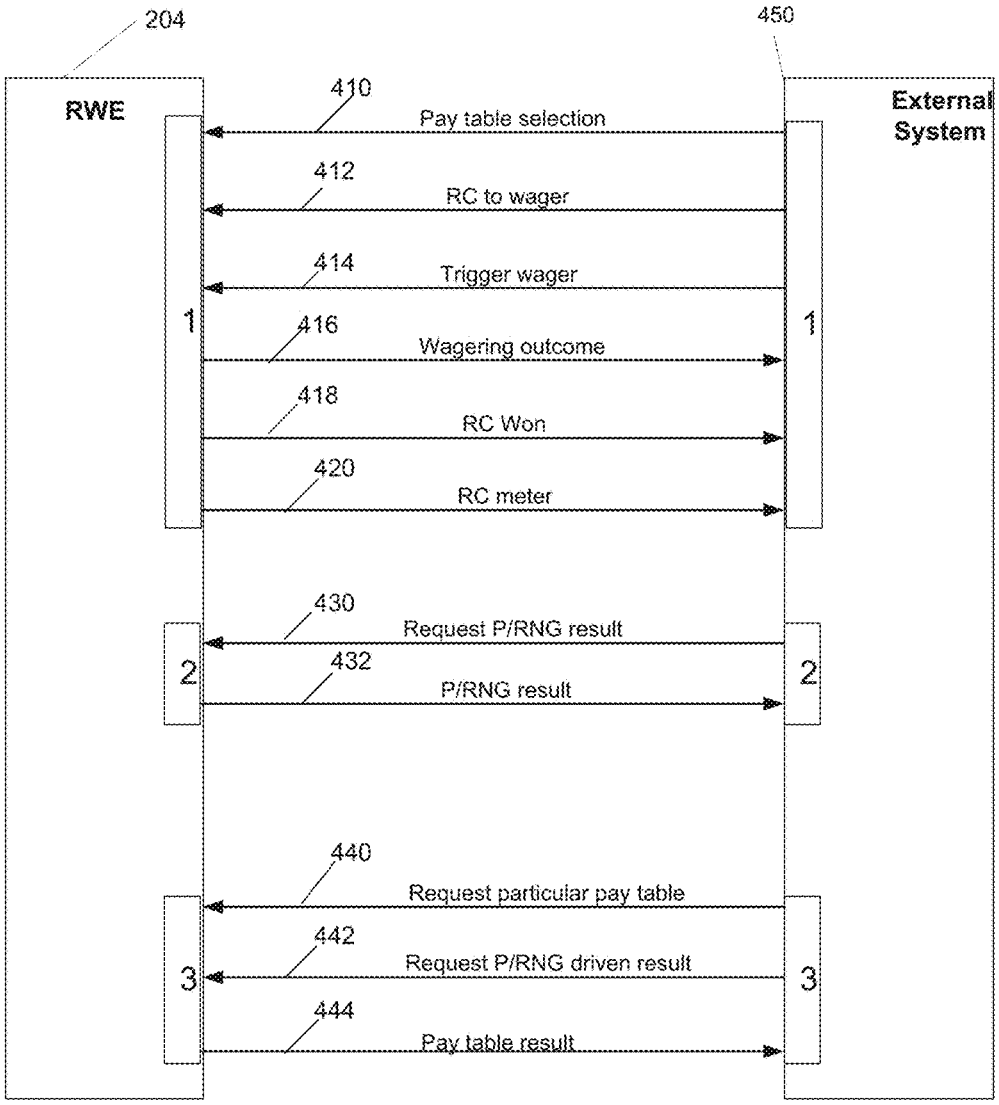
FIG. 4 illustrates a signaling diagram of communications between a Real World Engine (RWE) and an external system to provide various functions in accordance with embodiments of the invention.

The RWE and an external system typically communicate to provide the resolution of gambling events to resolve wagers on the events. The signals between the RWE and an external system to provide some process related to resolving gambling events in accordance with embodiments of the invention are shown in FIG. 4. In accordance with many embodiments of the invention, the primary function of the RWE 204 is to manage wagering events and to provide random (or pseudo random) numbers from an P/RNG. At the top of the figure, a 6 component communication exchange grouped by the "1" box is shown for a wager on a proposition in a gambling event during a gambling hybrid game in accordance with embodiments of the invention. An external system 450 that is requesting wagering support from the RWE 204 instructs the RWE 204 as to the pay table (Table Ln-RC) to use (410), followed by the amount of RC to wager on the proposition of the gambling event (412). Next, the external system 450 signals the RWE to trigger a wager or perform the gambling event (414). The RWE 204 resolves the gambling event. The RWE 204 then informs external system 450 as to the outcome of the wager (416), the amount of RC won (418), and the amount of RC in the player's account (in the credit repository) (420).

A second communication exchange between the RWE 204 and an external system 450 in accordance with embodiments of the invention that is shown in FIG. 4 is grouped by the "2" box in FIG. 4 and relates to the external system 450 needing an P/RNG result support from the RWE 204. In this exchange, the external system 450 requests an P/RNG result from the RWE 204 (430). The RWE 204 returns a P/RNG result to the external system 450 in response to the request (432). The result may be generated as a function of the internal P/RNG in the RWE 204, or from a P/RNG external to the RWE 204 to which the RWE 204 is connected.

A third communication exchange between the RWE 204 and the external system 450 in accordance with embodiments of the invention that is shown in FIG. 4 is grouped by the "3" box in the figure and relates to the external system 450 wanting support on coupling an P/RNG result to a particular pay table contained in the RWE 204. In this exchange, the external system 450 instructs the RWE as to the pay table (Table Ln-RC) to use (440). The external system (450) then requests a result whereby the P/RNG result is coupled to the requested pay table (442). The result is returned to the external system 450 by RWE 204 (444). Such an aspect is different from the first exchange shown by the box "1" sequence in that no actual RC wager is conducted. However, such a process, t, might be useful in coupling certain non-RC wagering entertainment game behaviors and propositions to the same final resultant wagering return which is understood for the gambling hybrid game to conduct wagering.

In regards to FIG. 4, one skilled in the art will note that the thrust of the FIG. 4 is to convey overall functional exchanges between an RWE 204 and an external system 450. As such, various protocol layers necessary for error free and secure communication, and other status, setup, and configuration commands which one might expect in any protocol between two connected systems have been omitted for clarity. Furthermore, some or all of the various commands and responses illustrated could be combined into one or more communication packets without departing from the invention.

Figure 5:
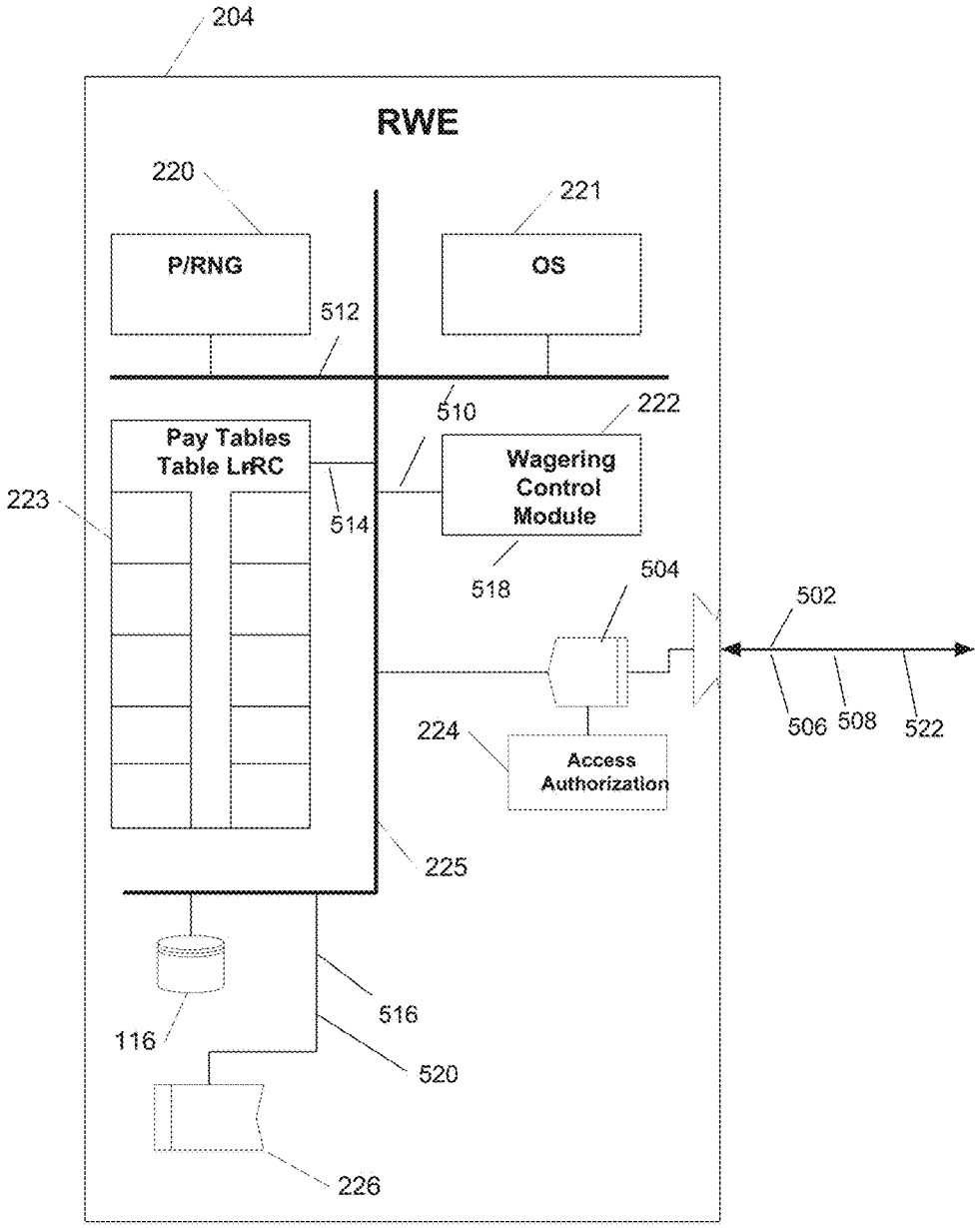
FIG. 5 illustrates a diagram of a process flow and signaling in a Real World Engine (RWE) to provide various functions in accordance with embodiments of the invention.

The process flow for functional communication exchanges, such as communication exchanges described above with reference to FIG. 4, between a RWE and an external system in accordance with embodiments of the invention are shown in FIG. 5. The process begins by a RWE 204 receiving signals from an external system requesting a connection to RWE 204 (502). The Access Authorization Module determines that the external system is authorized to connect to RWE 204 (504) and transmits an authorization response to the external system. The external systems provide a request for a gambling event to be performed to the RWE 294 (506). The request may include an indication of a wager amount on a proposition in the gambling event, and a proper pay table to use to resolve the wager. The external system then sends a signal to trigger the gambling event (508).

The OS 221 instructs the Wager Control Module 222 as to the RC wager and the pay table to select as well as to resolve the wager execution (510). In response to the request to execute the gambling event, the wager control module 222 requests an P/RNG result from the P/RNG 220 (512); retrieves a proper pay table or tables from the pay tables 223 (514); adjusts the RC of the player in the RC repository 226 as instructed (516); applies the P/RNG result to the particular pay table or tables (518); and multiplies the resultant factor from the pay table by the amount of RC to determine the result of the wager (518). Wager Control Module 222 then adds the amount of RC won by the wager to the RC repository 226 (520); and provides the outcome of the wager, and the amount of RC in the RWE and the RC won (522). One skilled in the art will recognize that there may be many embodiments of an RWE 204 which could be possible, including forms where many modules and components of the RWE are located in various servers and locations, so the foregoing is not meant to be exhaustive or all inclusive, but rather provide information about an RWE 204 in accordance with some embodiments of the invention.

Figure 6:
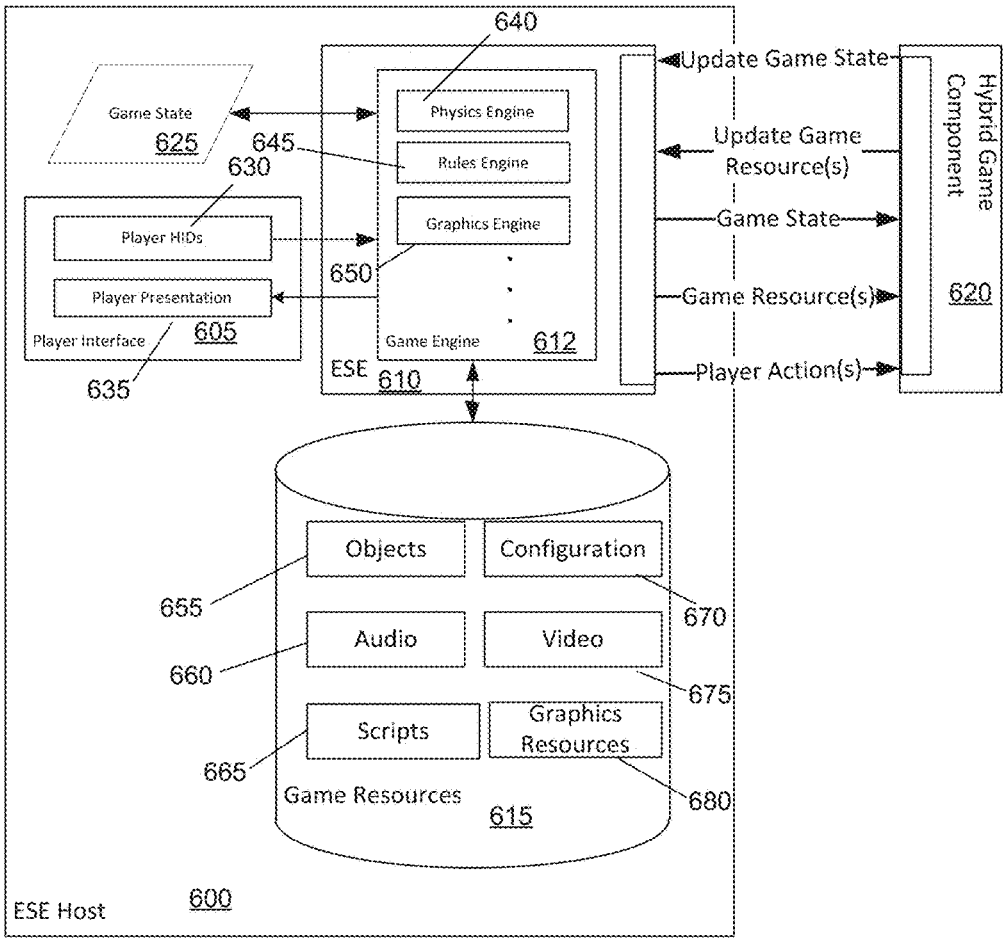
FIG. 6 illustrates a conceptual diagram of aspects of an Entertainment System Engine (ESE) in accordance with embodiments of the invention.

A block diagram of components of an ESE being provided by an ESE host 600 for a gambling hybrid game in accordance with embodiments of the invention is shown in FIG. 6. An ESE 610 may be part of the entertainment game itself, may be a software module that is executed by the entertainment game, or may provide an execution environment for the entertainment game for a particular host. The ESE 610 and associated entertainment game are hosted by an ESE host 600. The ESE host 600 is a computing device that is capable of hosting the ESE 610 and the entertainment game. Exemplary hosts include video game consoles, smart phones, personal computers, tablet computers, or the like. The entertainment game includes a game engine 612 that generates a player interface 605 for interaction with by a player. The player interface includes a player presentation 635 that is presented to a player through the player interface. The player presentation 635 may be audio, visual or tactile, or any combination of such. The player interface 635 further includes one or more Human Input Devices (HIDs) 630 that the player uses to interact with the entertainment game. Various components or sub-engines of the game engine read data from a game state in order to implement the features of the game. Components of the game engine include a physics engine 640 used to simulate physical interactions between virtual objects in the game state, a rules engine 645 for implementing the rules of the game, an P/RNG that may be used for influencing or determining certain variables and/or outcomes to provide a randomizing influence on gameplay, a graphics engine 650 used to generate a visual representation of the game state to the player, an audio engine to generate audio outputs for the player interface, and any other engine needed to provide the entertainment game. The game engine 612 reads and writes game resources 615 stored on a data store of the ESE host. The game resources 615 include game objects 655 having graphics and/or control logic used to implement game world objects of the game engine. The game resources 615 also include video files 675 that are used to generate cut-scenes for the entertainment game. The game resources 615 may also include audio files 660 used to generate music, sound effects, etc. within the entertainment game. The game resources 615 may also include configuration files 670 used to configure the features of the entertainment game. The game resources 615 may also include scripts 665 or other types of control code used to implement various gameplay features of the entertainment game. The game resources 615 may also include graphics resources 680 including, but not limited to, textures, and objects that are used by the game engine to render objects displayed in the entertainment game.

In operation, components of the game engine 612 read portions of the game state 625 and generate the player presentation for the player which is presented to the player using the player interface 605. The player perceives the presentation 635 and provides player inputs using the HIDs 630. The corresponding player inputs are received as player actions or inputs by various components of the game engine 612. The game engine translates the player actions into interactions with the virtual objects of the game world stored in the game state 625. Components of the game engine 612 use the player interactions with the virtual objects of the game and the game state 625 to update the game state 625 and update the presentation 635 presented to the user. The process can loop in a game loop continuously while the player plays the game.

In some embodiments, the ESE 610 is a host running a browser that communicates with a server serving documents in a markup language, such as Hypertext Markup Language 5 (HTML 5) or the like, and the functions of the game engine are performed by the browser on the basis of the markup language found in the documents. In some embodiments, the ESE 610 is a host hosting a specialized software platform, such as Adobe Flash or the like, used to implement games or other types of multimedia presentations, and the functions of the game engine are performed by the specialized platform.

The ESE 610 provides one or more interfaces between an entertainment game and other components 620 of a gambling hybrid game, such as a GWE. The ESE 610 and the other gambling hybrid game component 620 communicate with each other using the interfaces, such as by passing various types of data and sending and receiving messages, status information, commands and the like. Examples of communications include, but are not limited to, requesting by the gambling hybrid game component 620 that the ESE 610 update the game state using information provided by the other component; requesting, by the gambling hybrid game component 620, that the ESE 610 update one or more game resources using information provided by the gambling hybrid game component 620; the ESE 610 providing all or a portion of the game state; the ESE 610 providing one or more of the game resources to the gambling hybrid game component 620; and the ESE 610 communicating player actions to the other gambling hybrid game component 620. The player actions may be low level player interactions with the player interface, such as manipulation of an HID, or may be high level interactions with objects as determined by the entertainment game. The player actions may also include resultant actions such as modifications to the game state or game resources resulting from the player's actions taken in the game. Other examples of player actions include actions taken by entities, such as Non-Player Characters (NPC) of the entertainment game, that act on behalf of, or under the control of, the player.

Elements are a limited resource consumed within an entertainment game to advance entertainment game gameplay. In playing the entertainment game using the elements, a player can (optionally) consume and accrue game world credits (GWC) within the entertainment game. These credits may be in the form of (but are not limited to) game world credits, experience points, or points generally. Wagers may be made in the gambling game as triggered by the player's use of one or more elements of the entertainment game. The wagers are made using real world credits (RC). The real world credits may be credits in an actual currency, or may be credits in a virtual currency which may have a real world value. Gambling outcomes from the gambling game can cause consumption, loss or accrual of RC. In addition, gambling outcomes in the gambling game can influence elements in the entertainment game such as (but not limited to) by restoring a consumed element, causing the loss of an element, restoration or placement of a fixed element. In certain embodiments, gambling games can facilitate the wager of GWC for a randomly generated payout of GWC or a wager of elements for a randomly generated payout of elements. In particular embodiments, an amount of GWC and/or elements used as part of a wager can have a RC value if cashed out of a gameplay session.

Example elements include enabling elements (EE) which are elements that enable a player's play of the entertainment game and whose consumption by the player while playing the entertainment game can trigger a wager in a gambling game. Another non limiting example of an element is a reserve enabling element (REE), which is an element that converts into one or more enabling elements upon occurrence of a release event in skill wagering interleaved game gameplay. Other types of elements include actionable elements (AE) which are elements that are acted upon to trigger a wager in the gambling game and may or may not be restorable during normal play of the entertainment game. Another type of element is a common enabling element (CEE) which as an element that may be shared by two or more players and the use of which by any of the players causes a wager to be triggered.

In progressing through entertainment game gameplay, elements may be utilized by a player during interactions with a controlled entity (CE) which is a character, entity, inanimate object, device or other object under control of a player.

Also, entertainment game gameplay progress and wager triggers may be dependent upon a game world variable such as, but not limited to: a required game object (RGO) which is a specific game object in an entertainment game acted upon for an AE to be completed (such as but not limited to a specific key needed to open a door); a required environmental condition (REC) which is a game state present within an entertainment game for an AE to be completed (such as but not limited to daylight whose presence enables a character to walk through woods); or a controlled entity characteristic (CEC) which is a status of the CE within an entertainment game for an AE to be completed (such as but not limited to a CE to have full health points before entering battle). Although various gameplay resources, such as but not limited to GWC, RC and elements as discussed above, any gameplay resource may be utilized to advance gameplay as well as form the basis for a trigger of a wager as appropriate to the specification of a specific application in accordance with various embodiments of the invention. Various hybrid games are discussed in PCT Application Nos. PCT/US11/26768, filed Mar. 1, 2011, PCT/US11/63587, filed Dec. 6, 2011, and PCT/US12/50204 filed Aug. 9, 2012, each disclosure of which is hereby incorporated by reference in its entirety.

Figure 7:
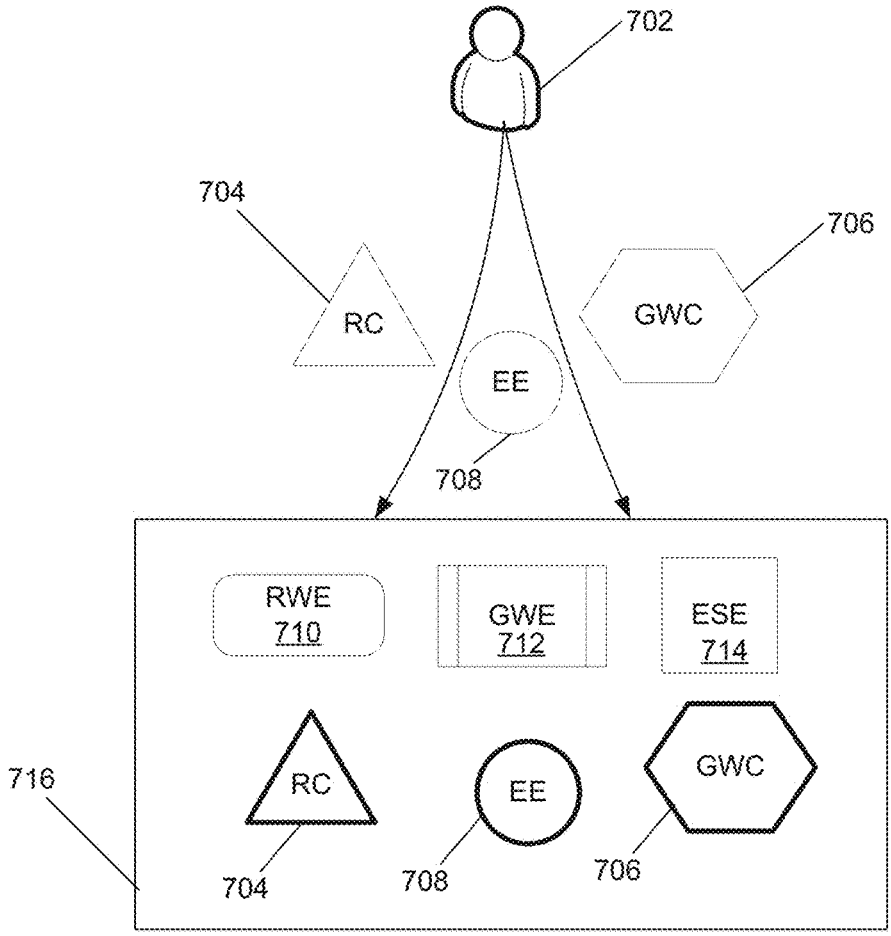
FIG. 7 illustrates a conceptual diagram of interactions between a user and a gambling hybrid game in accordance with embodiments of the invention.

In accordance with some embodiments, a player can interact with a gambling hybrid game by using RC in interactions with a gambling game along with GWC and elements in interactions with an entertainment game. The gambling game may be executed by a RWE while an entertainment game may be executed with an ESE and managed with a GWE. A conceptual diagram that illustrates how resources such as GWC, RC and elements, such as but not limited to enabling elements (EE), are utilized in a gambling hybrid game in accordance with an embodiment of the invention is illustrated in FIG. 7. The conceptual diagram illustrates that RC 704, EE 708 and GWC 706 may be utilized by a player 702 in interactions with the RWE 710, GWE 712 and ESE 714 of a gambling hybrid game 716. The contribution of elements, such as EE 708, may be linked to a player's access to credits, such as RC 704 or GWC 706. Electronic receipt of these credits can come via a smart card, voucher or other portable media, or as received over a network from a server. In accordance with certain embodiments, these credits may be drawn on demand from a player profile located in a database locally on a gambling hybrid game or in a remote server.

Figure 8:
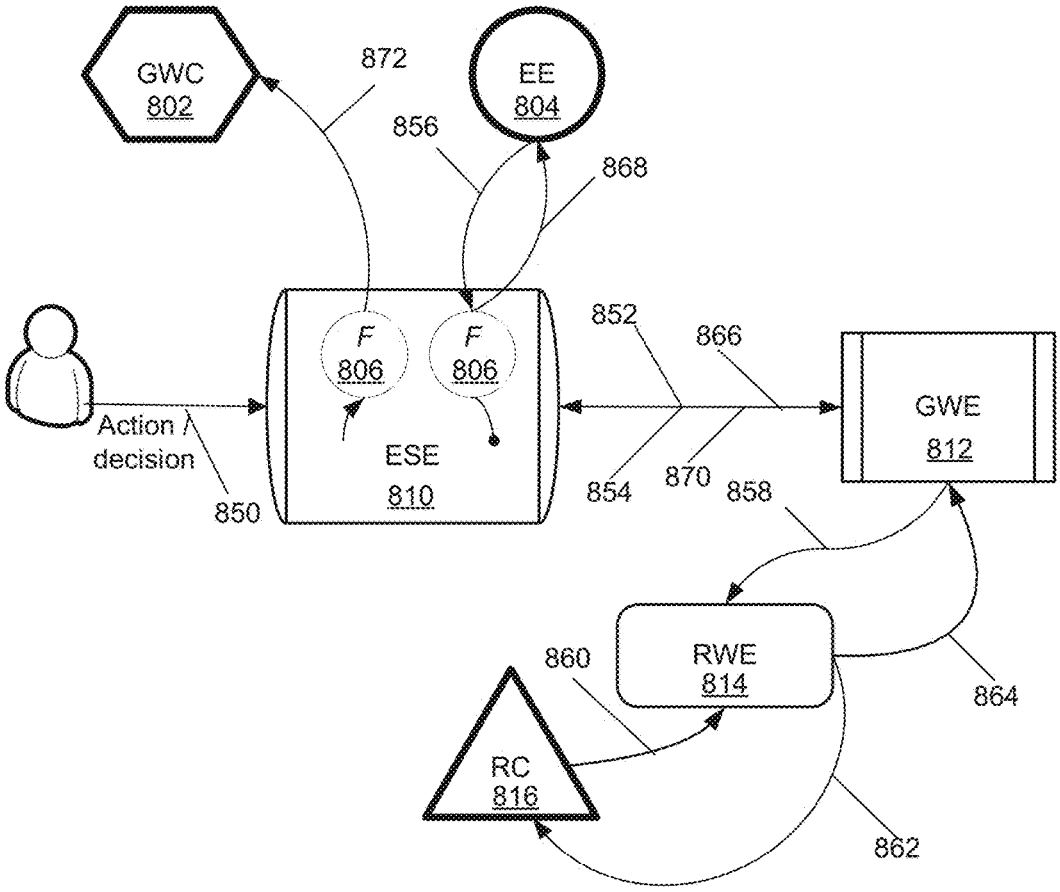
FIG. 8 illustrates a conceptual diagram of the interplay between aspects of a gambling hybrid game in accordance with some embodiments of the invention using Real World Currency (RC).

A conceptual diagram that illustrates the interplay between aspects of a gambling hybrid game in accordance with an embodiment of the invention using real world credit (RC) is illustrated in FIG. 8. Similar to FIG. 7, a player's actions and/or decisions can affect functions 806 that consume and/or accumulate GWC 802 and/or EE 804 in an entertainment game executed by an ESE 810. A GWE 812 can monitor the activities taking place within an entertainment game executed by an ESE 810 for gameplay gambling event occurrences. The GWE 812 can also communicate the gameplay gambling event occurrences to an RWE 814 that triggers a wager of RC 816 in a gambling game executed by the RWE 814.

In accordance with some embodiments of the invention, the following may occur during use of the gambling hybrid game. The user enters an input that represents an action or decision (850). The ESE 810 signals the GWE 812 with the input decision or action (852). The GWE 812 responds by signaling to ESE 810 with the amount of EE that is consumed by the player action or decision (854). The signaling from the GWE 812 configures a function 806 to control the EE consumption, decay, and/or accumulation.

The ESE 810 then adjusts the EE 804 accordingly (856). The GWE 812 signals the RWE 814 as to the profile of the wager proposition associated with the action or decision and triggers the wager (858). The RWE 814 consumes the appropriate amount of RC 816 and executes the wager (860). The RWE 814 then adjusts the RC 816 based upon the outcome of the wager (862) and informs the GWE 812 as to the outcome of the wager (864).

The GWE 812 signals the ESE 810 to adjust EE to one or more of the EEs of the ESE entertainment game (866). Function 806 of the ESE 810 performs the adjustment of EE 804 (868). The ESE 810 signals the GWE 812 as to the updated status (870). In response, the GWE 812 signals the ESE 810 to update GWC of the entertainment game. The ESE updates the GWC 802 using a function 806 (872).

The following is an example of the above flow in a first person shooter game, such a Call of Duty®, using a gambling hybrid game sequence in accordance with embodiments of the invention.

The process begins by a player selecting a machine gun to use in the game and then fires a burst of bullets at an opponent (850). The ESE 810 signals the GWE 812 of the player's choice of weapon, that a burst of bullets was fired, and the outcome of the burst (852). GWE 812 processes the information received and signals ESE 810 to consume 3 bullets (EE) with each pull of the trigger (854). The ESE 810 consumes 3 bullets for the burst using function 806 (856).

The GWE 812 signals the RWE 814 that 3 credits (RC) are to be wagered to match the three bullets consumed. The RWE 814 then determines the result of the wager and may determine the winnings from a pay table. On a particular pay table (Table Ln-RC), a determination is made by RWE 814 as to the amount of damage that the opponent has sustained. The RWE 814 consumes 3 credits of RC 816 for the wager and executes the specified wager (860). The RWE 814 determines that the player hit a jackpot of 6 credits and returns the 6 credits to the RC 816 (862) and signals the GWE 812 that 3 net credits were won by the player (864).

The GWE 812 signals ESE 810 to add 3 bullets to an ammunition clip (866). ESE 810 adds 3 bullets back to the ammo clip (EE 804) using a function 806 (868). The ammunition may be added by directly adding the ammunition to the clip or by allowing the user to find extra ammunition during gameplay. The GWE 812 logs the new player score (GWC 802) in the game (as a function of the successful hit on the opponent) based on the ESE 810 signaling, and the signals the ESE 810 to add 2 extra points to the player score since a jackpot has been won (870). The ESE 810 then adds 10 points to the player score (GWC 802) given the success of the hit which in this example is worth 8 points, plus the 2 extra points requested by GWE 812 (872). Note that the foregoing example is only intended to provide an illustration of how credits flow in a gambling hybrid game, but is not intended to be exhaustive and only lists only one of numerous possibilities of how a gambling hybrid game may be configured to manage its fundamental credits.

Figure 9:
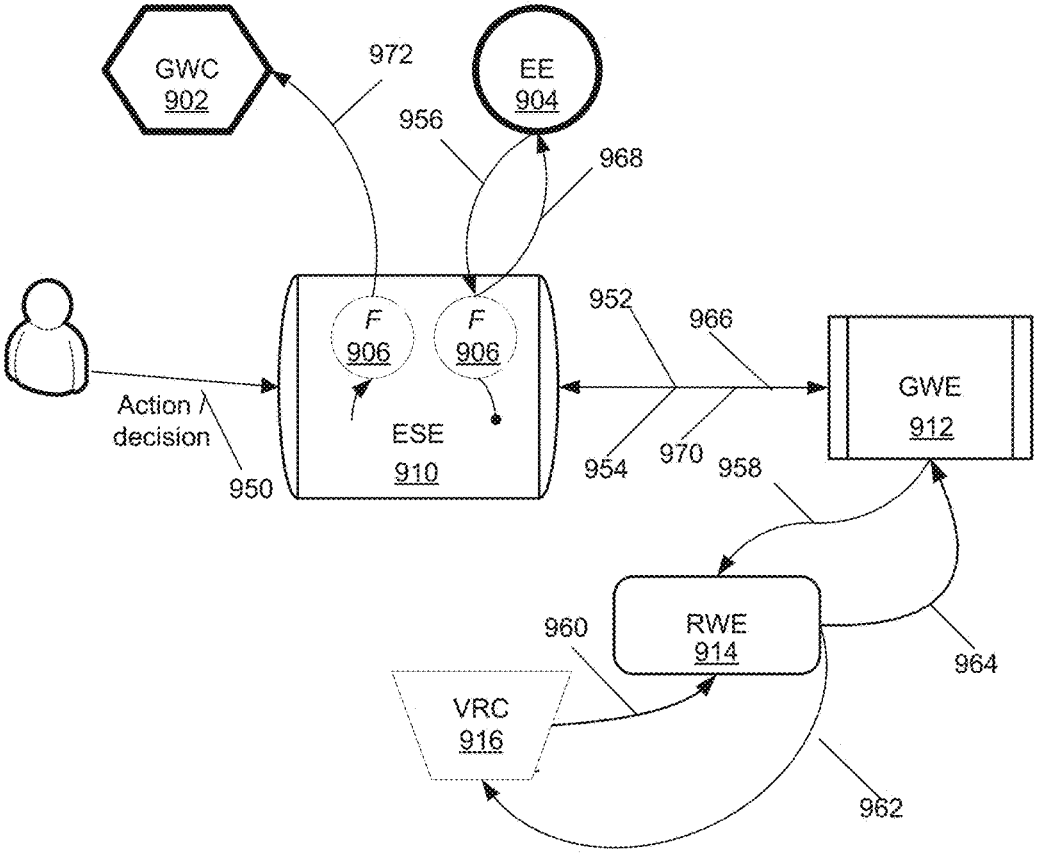
FIG. 9 illustrates a conceptual diagram of the interplay between aspects of a gambling hybrid game in accordance with other embodiments of the invention using Virtual Real World Currency (VRC).

A conceptual diagram that illustrates the interplay between aspects of a gambling hybrid game in accordance with an embodiment of the invention using virtual real world credit (VRC) is illustrated in FIG. 9. As seen in the FIG. 9, substituting VRC in place of RC is effected without impact to the architecture or operation of the gambling hybrid game. The implementation of FIG. 9 is not the only embodiment using virtual currency within a gambling hybrid game, but shows only one permutation of which many could exist.

Similar to FIG. 8, a player's actions and/or decisions can affect functions 906 that consume and/or accumulate GWC 902 and/or EE 904 in an entertainment game executed by an ESE 910 in the process shown in FIG. 9. A GWE 912 can monitor the activities taking place within an entertainment game executed by an ESE 910 for gameplay gambling event occurrences. The GWE 912 can also communicate the gameplay gambling event occurrences to a RWE 914. Unlike the process shown in FIG. 8, RWE 914 triggers a wager of virtual real world credit (VRC) 916 in a gambling game executed by the RWE 914.

For purposes of this discussion, VRC may be thought of as a form of alternate currency, which may be acquired, purchased or transferred, in unit or in bulk, by/to a player, but does not necessarily directly correlate to RC or real currency. As an example, there is a virtual currency called "Triax Jacks", 1000 units of which are given to a player by an operator of a gambling hybrid game, with additional blocks of 1000 units being available for purchase for $5 USD each block. Triax Jacks could be redeemed for various prizes, or could never be redeemed but simply used and traded purely for entertainment value by players. It would be completely consistent with the architecture of the gambling hybrid game that Triax Jacks would be wagered in place of RC, such that the gambling hybrid game could be played for free, or with played with operator sponsored Triax Jacks.

Returning to the process in FIG. 9, the following may occur during use of the gambling hybrid game in accordance with embodiments of the invention. The user enters an input that represents an action or decision (950). The ESE 910 signals the GWE 912 with the input decision or action (952). The GWE 912 responds by signaling to ESE 910 with the amount of EE that is consumed by the player action or decision (954). The signaling from the GWE 912 configures a function 906 to control the EE consumption, decay, and/or accumulation.

The ESE 910 then adjusts the EE 904 accordingly (956). The GWE 912 signals the RWE 914 as to the profile of the wager proposition associated with the action or decision and triggers the wager (958). The RWE 914 consumes the appropriate amount of RC 916 and executes the wager (960). The RWE 914 then adjusts the RC 916 based upon the outcome of the wager (962) and informs the GWE 912 as to the outcome of the wager (964).

The GWE 912 signals the ESE 910 to adjust EE to one or more of the EEs of the ESE entertainment game (966). Function 906 of the ESE 910 performs the adjustment of EE 904 (968). The ESE 910 signals the GWE 912 as to the updated status (970). In response, the GWE 912 signals the ESE 910 to update GWC 902 of the entertainment game. The ESE updates the GWC 902 using a function 906 (972).

Network Based Gambling Hybrid Game

Figure 10:
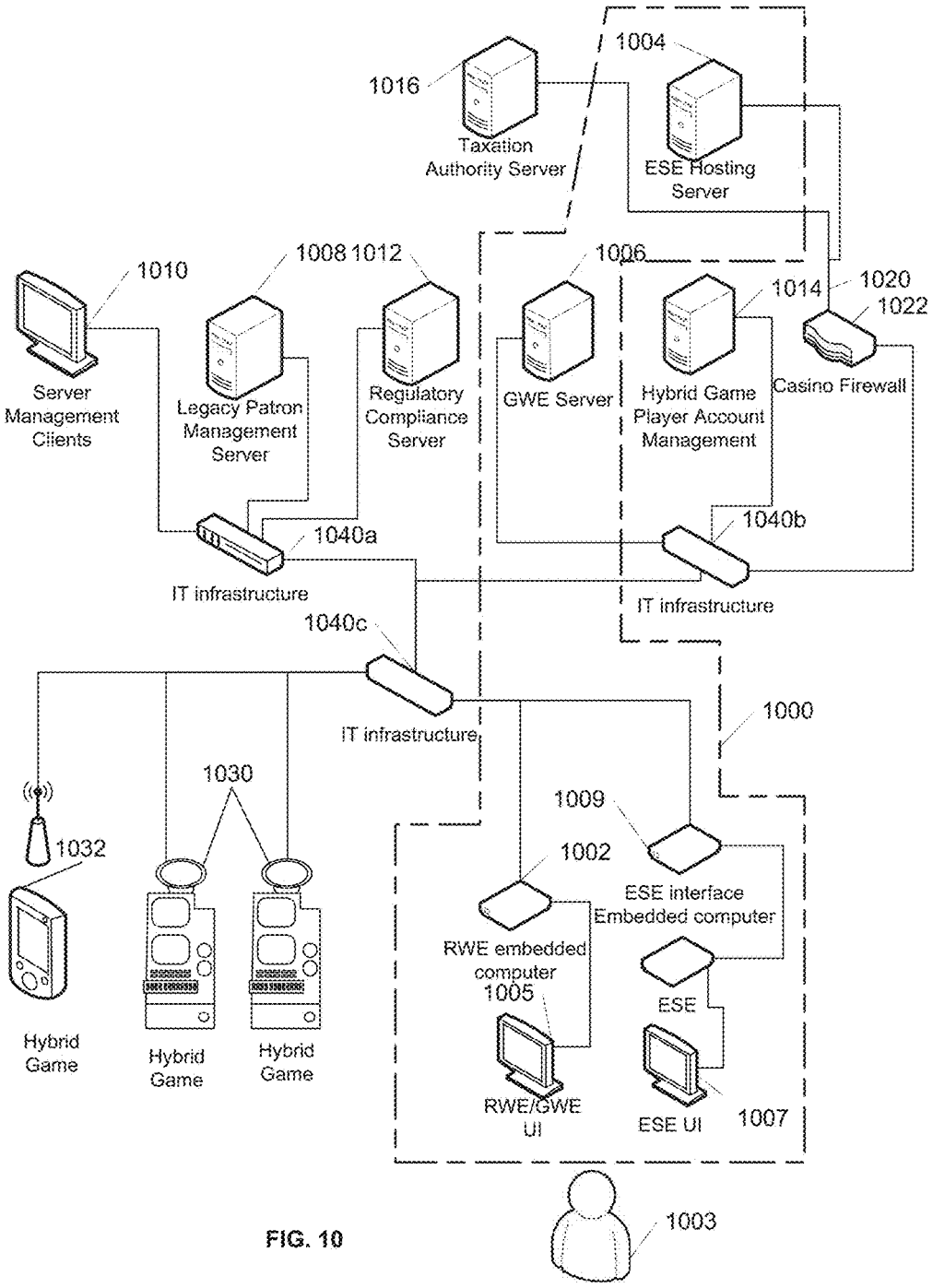
FIG. 10 illustrates a system diagram of an implementation of a network based gambling hybrid game in accordance with another embodiment of the invention.

A system diagram that illustrates an implementation of a network distributed gambling hybrid game with a GWE local server in accordance with embodiments of the invention is illustrated in FIG. 10. In the figure, the gambling hybrid game 1000 includes components, RWE 1002 embedded in a device used as the user interface for player 1003. The device provides both a RWE/GWE user interface 1005 and an ESE user interface 1007 for the player. The ESE is provisioned by an ESE hosting server 1004 via ESE interface 1009, and the GWE is provisioned by GWE server 1006 as indicated by the dashed line. Also pictured in the diagram are a number of other peripheral systems, such as player management 1008, casino management 1010, regulatory 1012, hybrid game player account management 1014, and taxation authority 1016 hosting servers that may be present in such an implementation. FIG. 10 also illustrates various other systems, which may reside outside the bounds of the casino and are connected to the framework via communications network, such as the Internet 1020, depicted by the connection lines past the casino firewall 1022. The end devices utilized for user interfaces for a gambling hybrid game include, but are not limited to, casino electronic game machines 1030 and wireless or portable devices, such as smart phone 1032, personal digital assistants, tablet computers, video gaming consoles or the like. These disparate devices are connected within and without the casino through the casino's information technology structure as illustrated by routers 1040*a*, 1040*b* and 1040*c*. It should be understood that FIG. 10 does not attempt to illustrate all servers and systems to which a gambling hybrid game 1000 might be inevitably be connected, and indeed one might expect there would be others, but rather provides an example of a set of a sub-set of systems which would be present in an exemplary embodiment of an installation.

Figure 11:
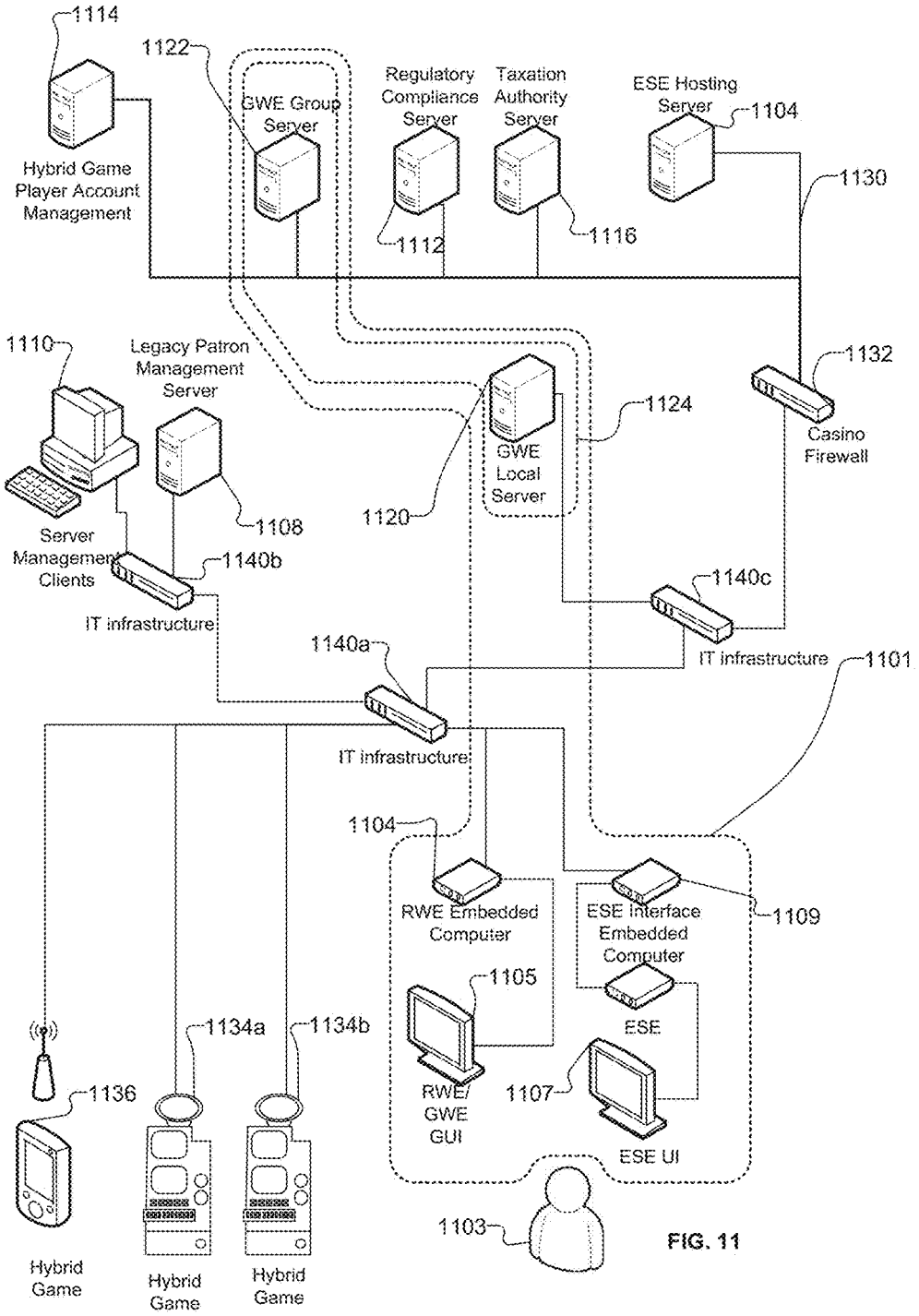
FIG. 11 illustrates a system diagram of an implementation of an Internet based gambling hybrid game in accordance with an embodiment of the invention.

FIG. 11 is a diagram showing another implementation of a gambling hybrid game in accordance with an exemplary embodiment. In the figure, the gambling hybrid game 1101 includes components, RWE 1104 embedded in a device used as the user interface for player 1103. The device provides both a RWE/GWE user interface 1105 and an ESE user interface 1007 for the player. The ESE is provisioned by an ESE hosting server 1104 via ESE interface 1109. Also pictured in the diagram are a number of other peripheral systems, such as player management 1108, casino management 1110, regulatory 1112, hybrid game player account management 1114, and taxation authority 1116 hosting servers that may be present in such an implementation. In the figure, note that the GWE is composed of two sub-components, a local GWE server 1120, and a cloud server 1122 (components within the dash line area 1124). In the figure, certain of the components are located within the bounds of the casino, namely the RWE, the ESE and a portion of the GWE, namely the local GWE server 1120. The Cloud Server GWE 1122 is located in the cloud connected to the casino bounded gambling hybrid game components via communications network such as the Internet 1130 through a firewall 1132. FIG. 11 also illustrates various other systems, which may reside outside the bounds of the casino and are connected to the framework via communications network. The end devices utilized for user interfaces for a gambling hybrid game include, but are not limited to, casino electronic game machines, 1134*a* and 1134*b*, and wireless or portable devices, such as smart phone 1136, personal digital assistants, tablet computers, video gaming consoles or the like. These disparate devices are connected within and without the casino through the casino's information technology structure as illustrated by routers 1140*a*, 1140*b* and 1140*c*. It should be understood that FIG. 11 does not attempt to illustrate all servers and systems to which a gambling hybrid game might be inevitably be connected, and indeed one might expect there would be others, but rather provides an example of a set of a sub-set of systems which would be present in an exemplary embodiment of an installation.

Figure 12:
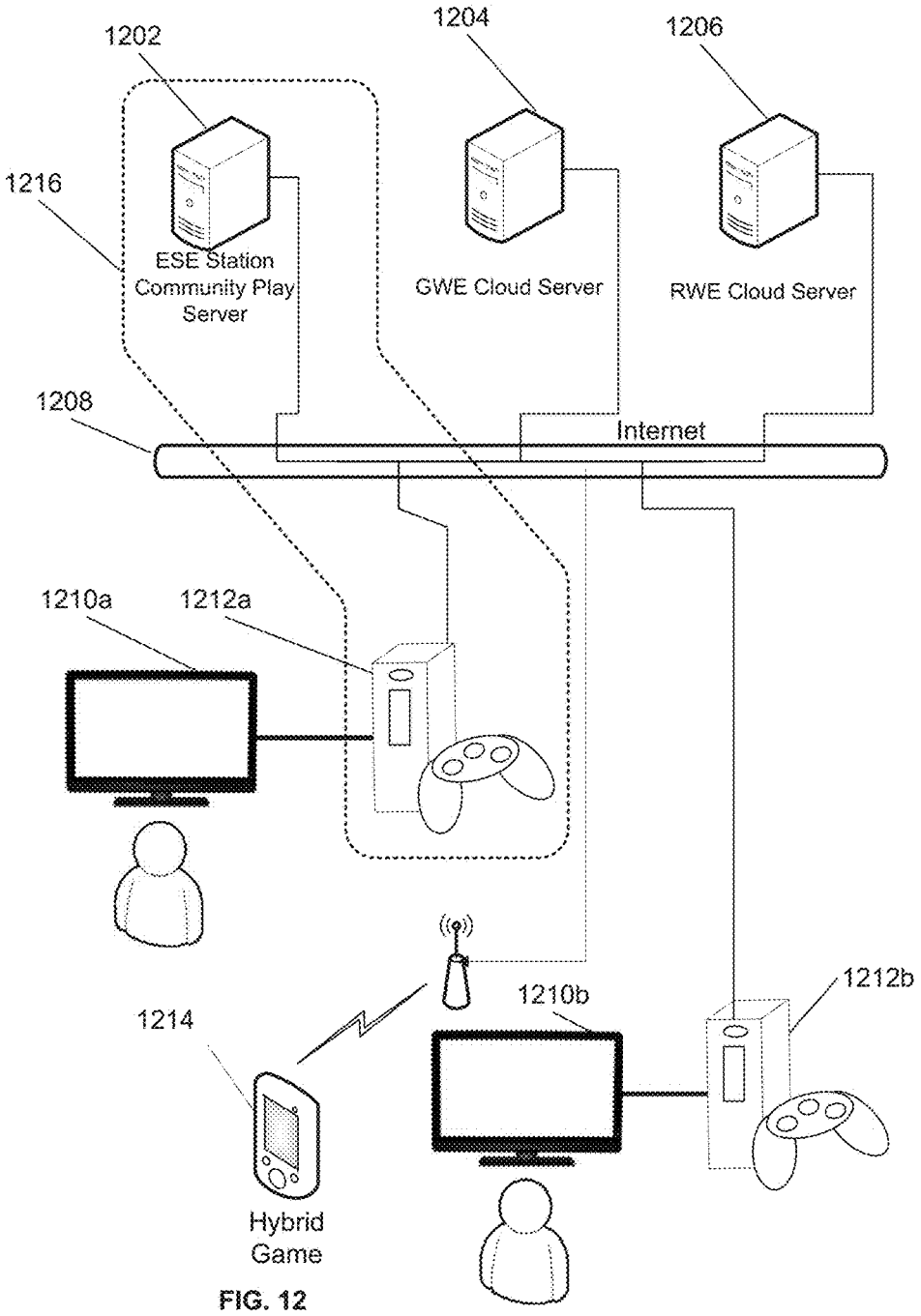
FIG. 12 illustrates a system diagram of an implementation of a cloud based gambling hybrid game in accordance with an embodiment of the invention.

A system diagram that illustrates an implementation of network a cloud based gambling hybrid game over the Internet in accordance with an embodiment of the invention is illustrated in FIG. 12. The system includes an ESE server 1202, GWE server 1204 and RWE server 1206 that each connect to a user interface, 1210*a* or 1210*b*, (such as, but not limited to, a television screen, computer terminal, tablet, touchscreen or PDA) of gambling hybrid games over the Internet 1208. Each gambling hybrid game includes a local ESE 1212*a* or 1212*b* (such as, but not limited to, a video game console or a gaming computer system) that interfaces with a remote ESE server 1002. Processes performed by an ESE 1212*a* services may be performed in multiple locations, such as, but not limited to, remotely on an ESE server 1202 and locally on a local ESE 1212*a*. In addition, a gambling hybrid game may include a Personal Digital Assistant (PDA) 1214 or other type of mobile computing device game coupled to the ESE hosting server 1202, thus providing the opportunity for a player to play a gambling hybrid game on the PDA through a mobile phone or data network.

There are many possible permutations of how a gambling hybrid game could be constructed, with FIGS. 10, 11 and 12 showing only three possible permutations and provided as examples, which are not intended to suggest limitations to the forms of the architecture. Other embodiments include a version where the entire gambling hybrid game is in the cloud with only a client running on player terminal within the bounds of the casino, or a version where the RWE and GWE are casino bound and the ESE exists in the cloud, accessed by a client running on a terminal in the casino.

Processing Apparatuses

Figure 13:
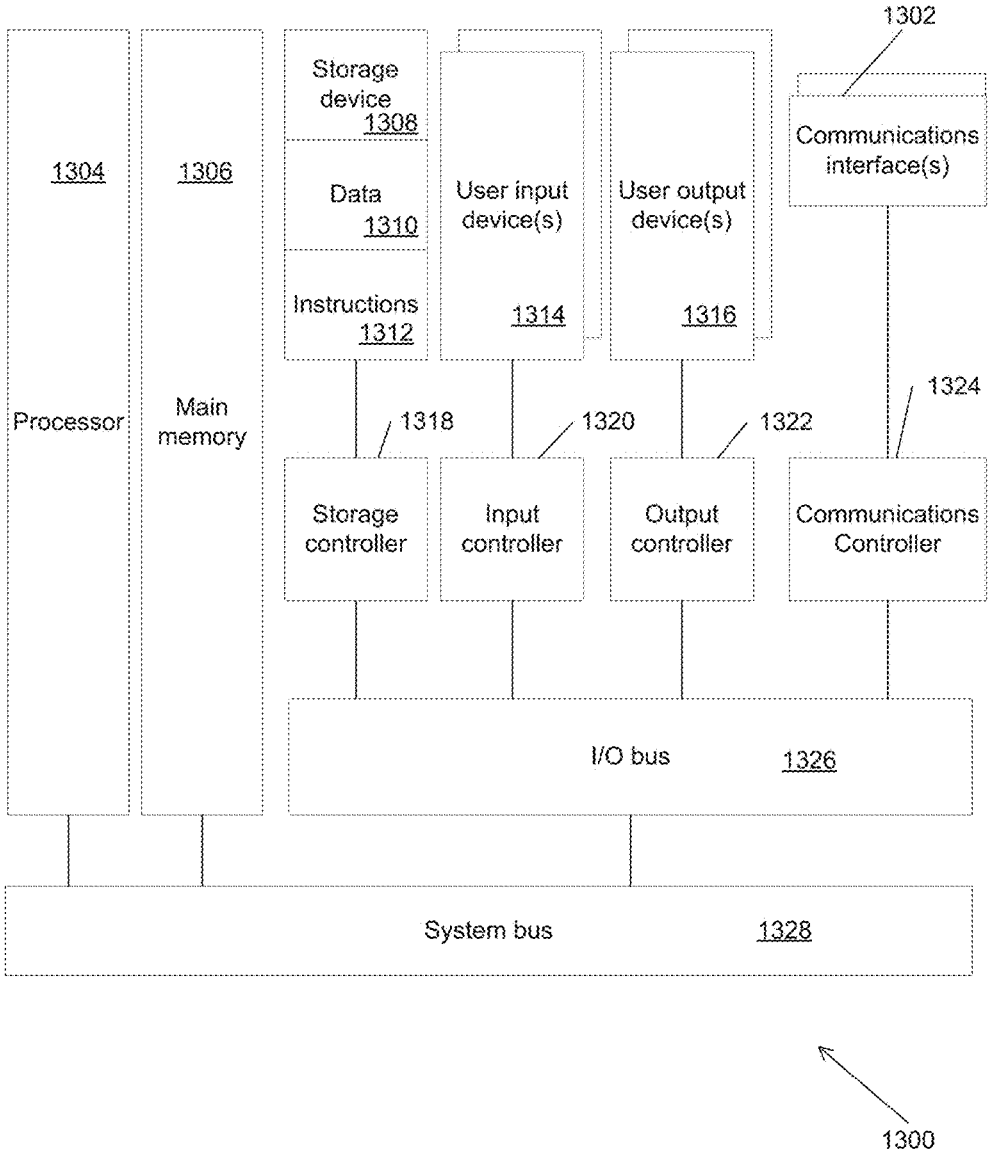
FIG. 13 illustrates a block diagram of components of a device implementing a gambling hybrid game in accordance with an embodiment of the invention.

Any of a variety of processing apparatuses can host various components of a gambling hybrid game in accordance with embodiments of the invention. In accordance with embodiments of the invention, these processing apparatuses can include, but are not limited to, a server, a client, a mobile device such as a smartphone, a personal digital assistant or the like, a wireless device such as a tablet computer or the like, an electronic gaming machine, a general purpose computer, a gaming console, a computing device and/or a controller. A processing apparatus that is constructed to implement a gambling hybrid game in accordance with embodiments of the invention is illustrated in FIG. 13. In the processing apparatus 1300, a processor 1304 is coupled to memory 1306 by a bus 1328. The processor 1304 is also coupled to non-transitory machine-readable storage media, such as a storage device 1308 that stores executable instructions 1312 and data 1310 through the system bus 1328 to an I/O bus 1326 through a storage controller 1318. The processor 1304 is also coupled to one or more interfaces that may be used to connect the processor to other processing apparatuses as well as networks as described herein. The processor 1304 is also coupled via the bus to user input devices 1314, such as tactile devices including, but not limited to, keyboards, keypads, foot pads, touch screens, and/or trackballs; as well as non-contact devices such as audio input devices, motion sensors and motion capture devices that the processing apparatus can use to receive inputs from a user when the user interacts with the processing apparatus. The processor 1304 is connected to these user input devices 1314 through the system bus 1328, to the I/O bus 1326 and through the input controller 1320. The processor 1304 is also coupled via the bus to user output devices 1316 such as (but not limited to) visual output devices, audio output devices, and/or tactile output devices that the processing apparatus uses to generate outputs perceivable by the user when the user interacts with the processing apparatus. In accordance with some embodiments, the processor is coupled to visual output devices such as (but not limited to) display screens, light panels, and/or lighted displays. In accordance with particular embodiments, the processor is coupled to audio output devices such as (but not limited to) speakers, and/or sound amplifiers. In accordance with many of these embodiments, the processor 1304 is coupled to tactile output devices like vibrators, and/or manipulators. The processor 1304 is connected to output devices from the system bus 1328 to the I/O bus 1326 and through the output controller 1322. The processor 1304 can also be connected to a communications interface 1302 from the system bus 1328 to the I/O bus 1326 through a communications controller 1324.

In accordance with various embodiments, a processor 1304 can load instructions and data from the storage device into the memory 1306. The processor 1304 can also execute instructions that operate on the data to implement various aspects and features of the components of a gambling hybrid game. The processor 1304 can utilize various input and output devices in accordance with the instructions and the data in order to create and operate user interfaces for players or operators of a gambling hybrid game (such as but not limited to a casino that hosts the gambling hybrid game).

Although the processing apparatus 1300 is described herein as being constructed from a processor and instructions stored and executed by hardware components, the processing apparatus may be composed of only hardware components in accordance with other embodiments. In addition, although the storage device is described as being coupled to the processor through a bus, those skilled in the art of processing apparatuses will understand that the storage device can include removable media such as, but not limited to, a USB memory device, an optical CD ROM, magnetic media such as tape and disks. Also, the storage device may be accessed by processor 1304 through one of the interfaces or over a network. Furthermore, any of the user input devices or user output devices may be coupled to the processor 1304 via one of the interfaces or over a network. In addition, although a single processor 1304 is described, those skilled in the art will understand that the processor 1304 may be a controller or other computing device or a separate computer as well as be composed of multiple processors or computing devices including one or more processors.

Gambling Hybrid Game with Game World Engine Triggering

Figure 14:
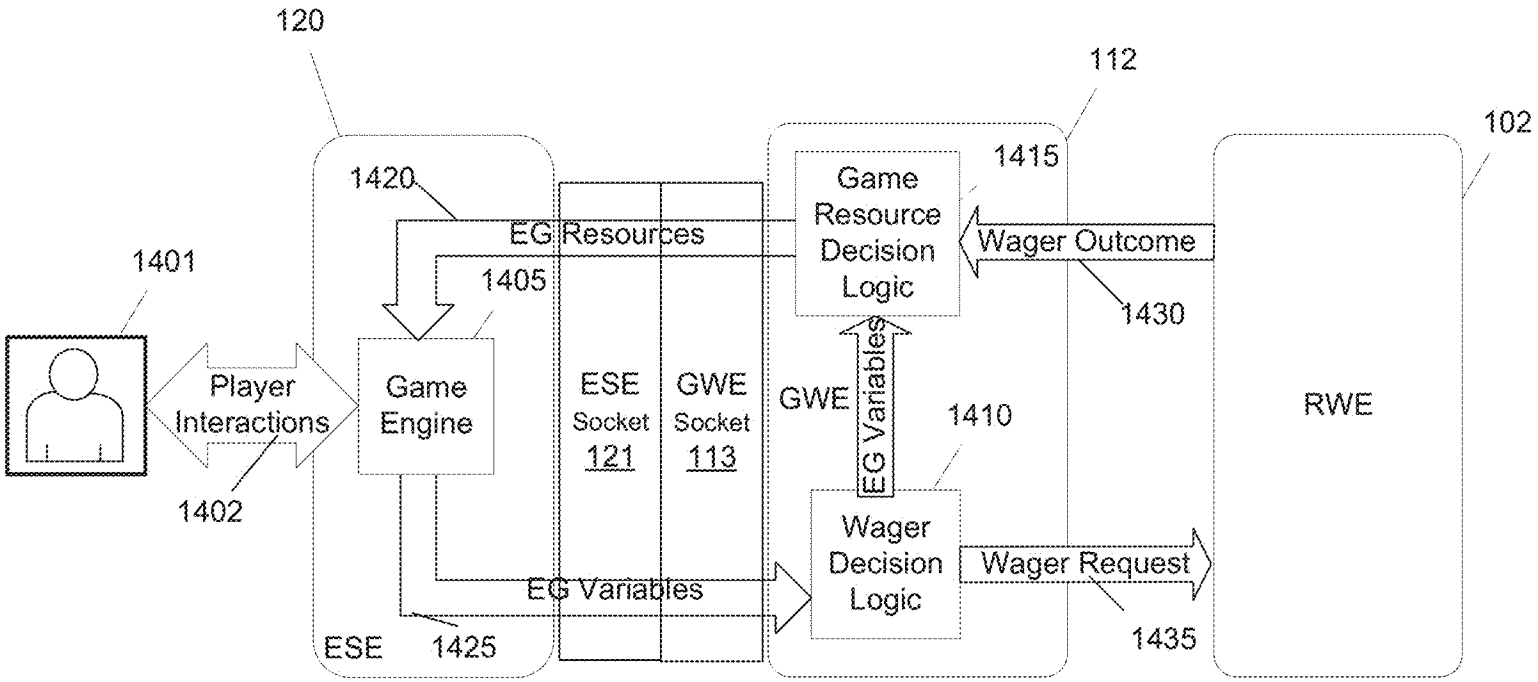
FIG. 14 illustrates a conceptual diagram of components of a gambling hybrid game having a game world engine that triggers gambling events in a gambling game based upon a game state of an entertainment game represented by entertainment game variables in accordance with an embodiment of the invention.

In accordance with many embodiments of the invention, a game world engine of a gambling hybrid game uses the game state of the entertainment game represented by entertainment game variables to trigger gambling events in a gambling game. The components of a gambling hybrid game and the information passed between the components to provide game world engine triggering based upon entertainment game variables in accordance with embodiments of the invention are shown in FIG. 14. In FIG. 14, the gambling hybrid game includes an ESE 120, a GWE 112, and a RWE 102 as described above. The ESE 120 includes an entertainment game engine 1405 and the GWE 112 includes wager decision logic 1410 and game resource decision logic 1415.

The game engine 1405 provides the entertainment game to a player 1401. During game play of the entertainment game, game engine 1045 receives player interactions 1402 from the player 1401. Based on the player interactions 1402, the game engine 1405 generates entertainment game variables 1425 that represent the game state of the entertainment game. The entertainment game variables 1425 are received by the GWE 112 from the game engine 1405 of the ESE 120. In several embodiments, the entertainment game variables are received by polling in which the GWE 112 periodically requests the entertainment game variables 1425 from the ESE 120. In accordance with a number of embodiments, the entertainment game variables 1425 are received in a service request from the ESE 120 to the GWE 112.

In accordance with many embodiments, the GWE 112 uses the wager decision logic 1410 and the received entertainment game variables 1425 to determine whether or not a gambling event is triggered. If it is determined that a gambling event is triggered, the GWE 112 makes a gambling event or wager request 1435 to the real world engine (RWE) 102. In a number of embodiments, the wager decision logic 1410 also transmits the entertainment game variables 1425 to the game world resource decision logic 1415.

In accordance with some embodiments, the GWE 112 receives the gambling results that may include wager outcome 1430 from the RWE 102. Based on gambling results that may include wager outcome 1430, the game resource decision logic 1415 of the GWE 112 determines whether or not additional entertainment game resources 1420 are to be provided to game engine 1405 in the ESE 120 for use in the entertainment game. In accordance with many embodiments, the game resource decision logic 1415 of the GWE 112 determines whether or not additional entertainment game resources 1420 are to be provided to the entertainment game based upon the gambling results that may include wager outcome 1430 and the entertainment game variables 1425 provided by the wager decision logic 1410. In accordance with a number of embodiments, the GWE 112 generates the additional entertainment game resources and supplies the additional resources to the ESE 120 if additional entertainment game resources are to be supplied to the ESE 120.

In some embodiments, the ESE 120 and the GWE 112 communicate through an interface or socket. The socket includes two components, an ESE socket 121 and a GWE socket 113. The ESE socket is hosted by the same device that hosts the ESE, such as, but not limited to, a player's smartphone, a player's home computer, a player's mobile device such as a tablet computer, a casino's electronic gaming machine, a player's gaming console, or the like. The ESE socket encapsulates the communication protocols for communicating by the ESE 120 to the GWE 112. This includes, but is not limited to, transmitting entertainment game variables 1425 to the GWE 112 via the GWE socket 113 and receiving entertainment game resources 1420 from the GWE 112 via the GWE socket 113. In some embodiments, the ESE socket is instantiated as a separate service hosted by the ESE's device. The ESE socket may also be instantiated in a process separate from the ESE's process. In some embodiments, the ESE socket is implemented as a library that is linked to the ESE during run or build time. In some embodiments, the ESE socket is exposed to the ESE as a set of application programming interfaces that are utilized by the ESE. In many embodiments, the ESE socket is implemented directly within the ESE. In various embodiments, the ESE is a browser communicating with an internet server and the ESE is implemented as a browser plug in.

The GWE socket 113 is hosted by the same device that hosts the GWE, such as, but not limited to, a server or the like. The GWE socket encapsulates the communication protocols for communicating by the GWE 112 with the ESE 120. This includes, but is not limited to, receiving entertainment game variables 1425 from the ESE via the ESE socket 121 and transmitting entertainment game resources 1420 to the ESE via the ESE socket. In some embodiments, the GWE socket is instantiated as a separate service hosted by the GWE's device. The GWE socket may also be instantiated in a process separate from the GWE's process. In some embodiments, the GWE socket is provided as a library, the members of which are linked to the GWE during run or build time. In some embodiments, the GWE socket is exposed to the GWE as a set of application programming interfaces that are utilized by the GWE. In many embodiments, the GWE socket is implemented directly within the GWE.

In many embodiments, the ESE socket and the GWE socket communicate with each other via a network. In other embodiments, the ESE socket and GWE socket are within the same physical device but reside in different processes, in which case the ESE socket and GWE socket communicate using interprocess messages.

Although a specific process for game world engine triggering of gambling events in a gambling game based on entertainment game variables is described above with reference to FIG. 14, any of a variety of processes may be used in accordance with various embodiments of the invention.

Figure 15:
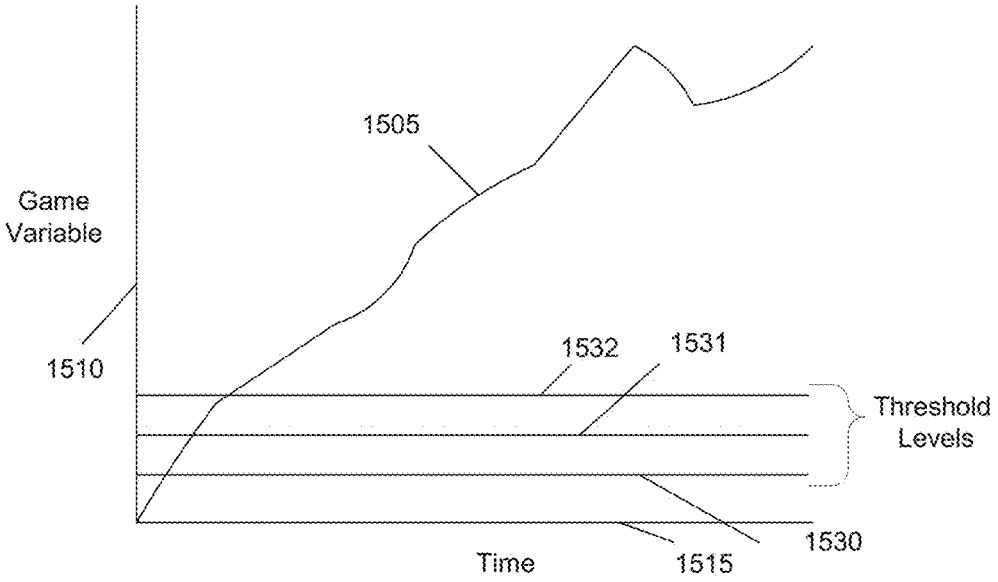
FIG. 15 illustrates a graph of the value of an entertainment game variable over time in accordance with embodiments of the invention.

Processes for Determining a Gambling Event is to Occur Based on Entertainment Game Variable(s) Using Wagering Logic in a GWE In accordance with some embodiments, the entertainment game (EG) variables 1425 may be discrete. For discrete variables, Boolean logic may be used by the wager decision logic to determine whether or not a wager should be made. In accordance with many embodiments, the EG variables may be continuous. As such, the EG may be expressed as a function of the variable vs time as shown in FIG. 15. In FIG. 15, the value of EG variable 1510 is expressed as the line 1505 representing the application of a function to EG variable 1510 over time 1515.

In accordance with some embodiments, the EG variable value is compared to one or more threshold values 1530-1532 and each time the EG variable value is equal to and/or greater than a threshold value 1530-1532, the GWE 112 determines a gambling event is triggered. In accordance with a number of embodiments, a first derivative may be determined for the function of the continuous EG variable and if the first derivative is equal to and/or greater than a specified value, the GWE 112 determines a gambling event is triggered. In accordance with many embodiments, a second derivative may be determined for the function of the continuous EG variable and if the sign of the second derivative changes, the GWE 112 determines a gambling event is to be triggered.

Figure 16:
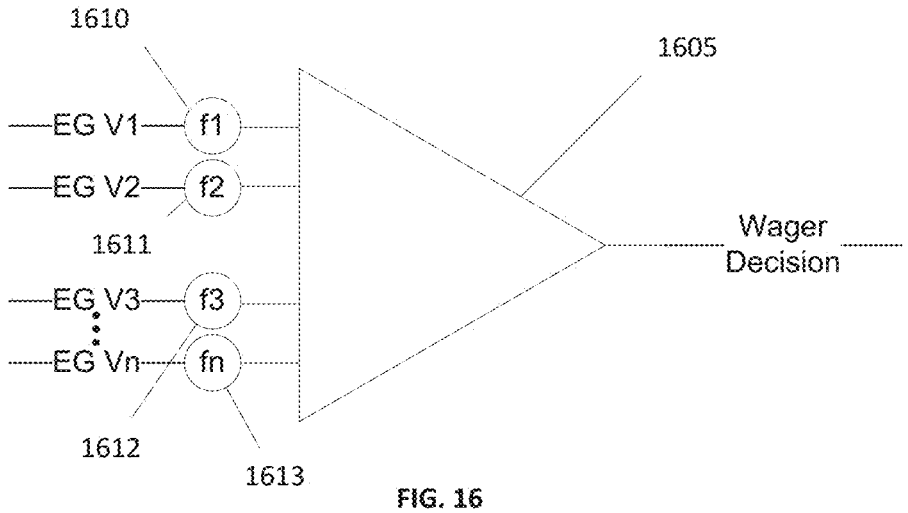
FIG. 16 illustrates a conceptual diagram of a function for determining whether a gambling event is triggered based upon multiple entertainment game variables in accordance with an embodiment of the invention.

In accordance with many embodiments, two or more EG variables may be combined to make a wager decision. A function that combines two or more EG variables to make a wager decision in accordance with embodiments of the invention is shown in FIG. 16. In FIG. 16, each EG variable may be provided as an input to a function 1610-1613 that conditions the value of the respective EG variable to convert it into a form that may be used in conjunction with the other EG variables. In some embodiments, the continuous EG variables are combined in a wager decision function 1605 by functions 1610-1613 normalizing each EG variable into a consistent range, such as between 0 and 1. Once normalized, the EG variables are summed and then any of the wager determination functions described herein are applied to determine if a gambling event is triggered. In accordance with many embodiments, the continuous EG variables are turned into discrete variables using any of the transformation functions 1610-1613 and wager decision function 1605 applies Boolean logic to determine if a gambling event is triggered. In accordance with other embodiments, discrete and continuous EG variables are utilized together by discretizing the continuous variables using functions 1610-1613 and wager decision function 1605 applies Boolean logic to determine if a gambling event is triggered. In accordance with a number of embodiments, the continuous EG variables are weighted by functions 1610-1613 such that one or more of the EG variables influence the wager decision function 1605 more than other EG variables.

In some embodiments, the wager decision logic 1410 is implemented as a set of rules that are satisfied by the entertainment game variables within a business rule management system. In various embodiments, the entertainment game variables are also used within the game resource decision logic 1415 to satisfy a set of rules using a business rule management system.

Although specific process for determining whether a gambling event occurs based upon EG variables are described above with reference to FIGS. 15-16. Any variety of processes may be used in accordance with various embodiments of the invention.

Embodiments of Gambling Hybrid Games Including GWE Triggering of Gambling Events Based on EG Variables.

Figure 17:
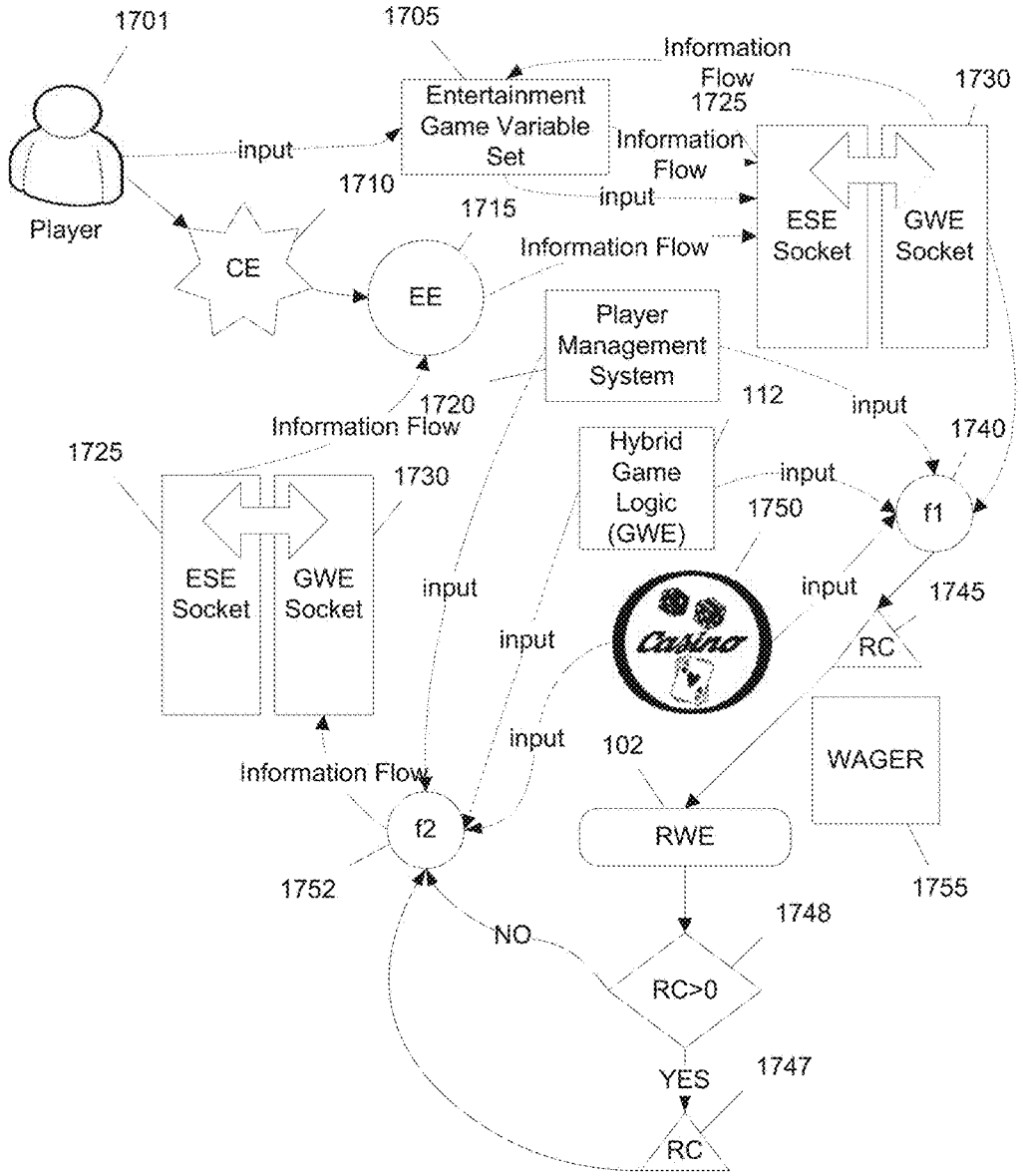
FIG. 17 illustrates a diagram showing components of a gambling hybrid game and the information passed between the components to provide game world engine triggering in accordance with an embodiment of the invention.

In accordance with several embodiments of the invention, a gambling hybrid game (HyG) is provided where the entertainment game does not trigger the gambling game. Rather, the game state of the entertainment game as represented by entertainment game variables is used to determine whether a gambling event in the gambling game is triggered. Components of a gambling hybrid game in accordance with these embodiments and the information passed between the components of the gambling hybrid game are shown in FIG. 17. In accordance with the shown embodiment, the ESE 102 provides the entertainment game. During game play, the ESE receives inputs from a user 1701 that cause changes in one or more EG variable in an EG game variable set 1705. The EG game variable set 1705 is provided by the ESE to the GWE through an ESE socket 1725 and a GWE socket 1730. In FIG. 17, an example of an input changing the game state is shown as the occurrence of an enabling element (EE) 1715 through a CE 1710 controlled by the user. The EE 1715 is registered as having occurred within the ESE socket 1725, such that the GWE socket 1730 receives an update indicating the occurrence, either by polling data within the ESE socket 1725, or by virtue of receiving an information packet from the ESE socket 1725.

In the illustrated embodiment, f1 1740 is a function within the GWE that receives information about the EG variable set 1705 from the GWE socket 1730. The function f1 1740 may also receive other information from the GWE 112 as well as information from other sources including, but not limited to, a player management system 1720; casino or provider systems 1750; and regulatory systems. The function f1 1740 can then apply a gambling event determination function to the received inputs to determine whether a gambling event is triggered. If a gambling event is triggered, the function f1 1740 can send a request for resolution of a gambling event to the RWE 102 that may include a specified amount of real credit (RC) 1745 in a wager 1755 on a proposition about the outcome of the gambling event. The RWE 102 undertakes the gambling game to provide the gambling event and returns a specific amount of RC 1747 and/or an indication of the results of the gambling event 1748 to the GWE 112.

The function f2 1752 is a function within the GWE 112 that receives the results of the gambling events from RWE 102 and determines any changes to be applied to the set of game variables based on the results of the gambling events. In accordance with some embodiments, the function f2 1752 may receive other inputs from various sources including, but not limited to, the GWE 112; the player management system 1720; the casino or provider system 1750; and the regulatory systems. These other inputs may also be used in the determination of the change in the set of EG variables 1705 in accordance with a number of embodiments. For example, the output of the function f2 1752 may be the amount of EE 1715 to be replenished in the entertainment game based on the results of the gambling event. The output of the function f2 1752 may be communicated back to the ESE via the GWE socket 1730-ESE Socket 1725 Interface. One skilled in the will note that in accordance with several embodiments of the invention the occurrence of the EE within the entertainment game does not trigger the gambling game. Instead, the EE serves as an input for a function f1 1740 within the GWE 112 that directly triggers the gambling event in the gambling game to take place in the RWE 102.

Although a specific process for providing GWE triggering of a gambling event based upon an EG variable in a gambling hybrid system is described above with reference to FIG. 17, any of a variety of processes may be used in accordance with various embodiments of the invention.

Figure 18:
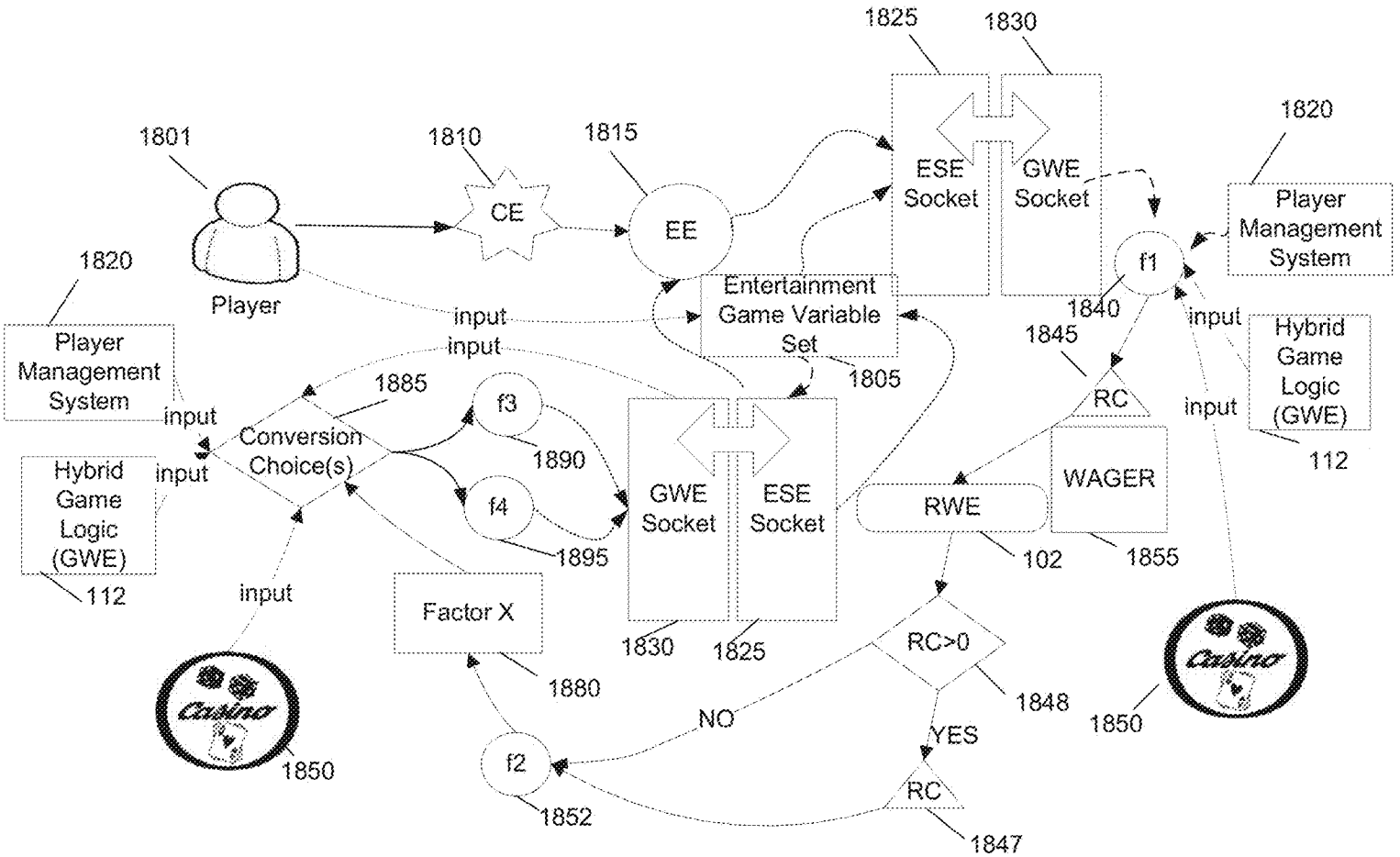
FIG. 18 illustrates a diagram showing components of a gambling hybrid game and the information passed between the components to provide game world engine triggering in accordance with another embodiment of the invention.

A GWE within a gambling hybrid game in accordance with some embodiments of the invention determines whether a gambling event is triggered based upon more than one of the EG variables. The components of a gambling hybrid game and the information passed between components of the gambling hybrid game to allow the GWE to determine whether to trigger a gambling event based on two or more EG variables in accordance with an embodiment of the invention are shown in FIG. 18. In accordance with the shown embodiment, the ESE 102 provides the entertainment game. During game play, the ESE receives inputs from the user 1801 that cause changes in one or more EG variables in an EG game variable set 1805 that are provided to the GWE 112 through an ESE socket 1825 and a GWE socket 1830. In some embodiments, the entertainment game variable set 1805 may require or accept input from the player, regarding aspects of game play. In FIG. 18, an example of an input changing the game state is shown as the occurrence of an EE 1815 through a CE 1810 controlled by the user. The EE 1815 is registered as having occurred within the ESE socket 1825, such that the GWE socket 1830 receives an update indicating the occurrence, either by polling data within the ESE socket 1825, or by virtue of receiving an information packet from the ESE socket 1825.

The function f1 1840 is a function within the GWE that receives information about the EG variable set 1805 from the GWE socket 1830. The function f1 1840 may also receive other information from the GWE 112 as well as information from other sources including, but not limited to, a player management system 1820; casino or provider systems 1850; and regulatory systems. The function f1 1840 then applies a gambling event determination function to the received inputs to determine whether a gambling event is triggered. In accordance with these embodiments, the function f1 1840 uses two or more of the EG variables from the EG variable set 1805 to determine whether a gambling event is triggered. If a gambling event is triggered, the function f1 1840 can send a request to resolve a gambling event in the gambling game to RWE 102. In accordance with some embodiments, the request may include a specified amount of real credit (RC) 1845 in a wager 1855 on a proposition about the outcome of the gambling event (in a real-money context, virtual currency (VC) may also be used). The RWE 102 undertakes the gambling event in the gambling game to provide the gambling results and can return a specific amount of RC 1847 and/or an indication of the results of the gambling game 1848 to the GWE 112.

The function f2 1852 is a function within the GWE 112 that receives the results of the gambling game 1847,1848 from the RWE 102 and determines whether or not any Factor X 1880, such as, but not limited to, Quanta, is to be awarded to the player. Factor X 1880 or Quanta is an intermediate in-game resource, which may be used to purchase and/or enable in game resources, such as enabling elements (EE) or actionable elements (AE), which may change the state of the entertainment game and/or offer the player benefits or advantages in the entertainment game. Factor X 1880 is awarded to the player based upon the results of the gambling game received from the RWE 103. In accordance with some embodiments, a winning wager (W>0) in the gambling event may result in Factor X 1880 being added; and a losing result (W<0) or push (W=0) for a wager in the gambling event may not result in Factor X 1880 being added. The exact algorithm for awarding Factor X 1880 in game may vary from game to game and/or from operator to operator.

Conversion choices 1885 may be provided to the user via the interface of the entertainment game. The conversion choices 1880 are items that may be received in exchange for Factor X 1880. The items change the state of the entertainment game and likewise the values of the EG variables that in the EG variable set 1805 represent the state of the game. The player, via the entertainment game variable set 1805 ESE socket 1825 and GWE socket 1830, may make a choice to convert Factor X into one or more entertainment game variables (of which EE may be one such option). The one or more EG variables affected by conversion choice(s) 1880 made within the GWE 112 can then be updated via functions f3 1890 and f4 1895. The updates to the set of EG variables 1805 are communicated to the ESE 120 via the GWE Socket 1830 and the ESE Socket 1825. The entertainment game variable set 1805 of the entertainment game, and/or EE (or AE, CEE, etc.) are then updated accordingly by the ESE.

In accordance with many embodiments of the invention, the decision logic to trigger a gambling event in a gambling game is not a result of a triggering event within the entertainment game of the ESE. Rather, two or more EG variables associated with the current game state within the ESE are used as variables by a function within the GWE that determines whether or not to trigger a gambling game. The availability of funds, casino and/or regulator driven parameters, player preferences, direct player input (e.g. a decision to gamble) and all other possible variables are brought to bear upon this decision within the GWE, not the ESE. The same is true for the conversion of gambling game wins into Factor X and the subsequent conversion of Factor X into specific entertainment game variables (including, but not limited to, EE).

Although certain specific features and aspects of a gaming system have been described herein, many additional modifications and variations would be apparent to those skilled in the art. For example, the features and aspects described herein may be implemented independently, cooperatively or alternatively without deviating from the spirit of the disclosure. It is therefore to be understood that a hybrid gaming system may be practiced otherwise than as specifically described. Thus, the foregoing description of the hybrid gaming system should be considered in all respects as illustrative and not restrictive, the scope of the claims to be determined as supported by this disclosure and the claims' equivalents, rather than the foregoing description.

What is claimed is:

1. A gaming system for providing a gambling hybrid game that includes an entertainment game and a gambling game, comprising:

a processing device constructed to:

execute the entertainment game, wherein the entertainment game updates a value for each entertainment game variable in a set of entertainment game variables and the set of entertainment game variables represents a state of the entertainment game, including at least one entertainment game variable;

communicate, to a game world server, a signal including a trigger of a wager based on the player's action during the player's skillful play of the entertainment game;

receive, from the game world server, a signal including a result of the wager triggered based on the player's action during the player's skillful play of the entertainment game;

display the result of the wager triggered based on the player's action during the player's skillful play of the entertainment game;

display an amount of intermediate in-game user resources that may be used to purchase or enable in-game resources based on the result of the wager triggered based on the player's action during the player's skillful play of the entertainment game;

communicate, to the game world server, a signal including the value for each entertainment game variable in the set of entertainment game variables; and receive, from the game world server, a signal including a change in the set of entertainment game variables;

a real world server constructed to:

receive, from the game world server, the signal including the trigger of the wager based on the player's action during the player's skillful play of the entertainment game;

determine the result of the wager triggered based on the player's action during the player's skillful play of the entertainment game;

communicate, to the game world server, the signal including the result of the wager triggered based on the player's action during the player's skillful play of the entertainment game;

receive, from the game world server, a signal including a trigger to resolve the wager based upon the signal including the value for each entertainment game variable in the set of entertainment game variables;

determine a result of the wager based upon the signal including the value for each entertainment game variable in the set of entertainment game variables; and communicate, to the game world server, the result of the wager based upon the signal including the value for each entertainment game variable in the set of entertainment game variables; and the game world server, connected to the processing device via a network and connected to the real world server via a communication link, constructed to:

continuously monitor the processing device for the signal including the trigger of the wager based on the player's action during the player's skillful play of the entertainment game;

receive, from the processing device, the signal including the trigger of the wager based on the player's action during the player's skillful play of the entertainment game;

communicate, to the real world server, the signal including the trigger of the wager based on the player's action during the player's skillful play of the entertainment game;

receive, from the real world server, the signal including the result of the wager triggered based on the player's action during the player's skillful play of the entertainment game;

calculate the amount of intermediate in-game user resources that may be used to purchase or enable in-game resources based on the result of the wager triggered based on the player's action during the player's skillful play of the entertainment game;

communicate, to the processing device, the signal including the result of the wager triggered based on the player's action during the player's skillful play of the entertainment game and the amount of intermediate in-game user resources;

receive, from the processing device, the signal including the value for each entertainment game variable in the set of entertainment game variables;

determine a wager in the gambling game is triggered based upon the signal including the value for each entertainment game variable in the set of entertainment game variables;

communicate, to the real world server, the signal including the trigger to resolve the wager based upon the signal including the value for each entertainment game variable in the set of entertainment game variables;

receive, from the real world server, the result of the wager based upon the signal including the value for each entertainment game variable in the set of entertainment game variables;

determine the change to the set of entertainment game variables based upon the result of the wager based upon the signal including the value for each entertainment game variable in the set of entertainment game variables; and communicate, to the processing device, the signal including the change to the set of entertainment game variables.

2. The gaming system of claim 1, wherein one variable in the set of entertainment game variables is a discrete variable and Boolean logic is used to determine whether the wager is triggered based on the discrete variable.

3. The gaming system of claim 2, wherein one variable in the set of entertainment game variables is a continuous variable and the determination of whether the wager is triggered is based upon a second derivative of the continuous variable.

4. The gaming system of claim 1, wherein one variable in the set of entertainment game variables is a continuous variable and the determination of whether the wager is triggered is based upon a comparison of the value of the continuous variable to a threshold value.

5. The gaming system of claim 1, wherein one variable in the set of entertainment game variables is a continuous variable and the determination of whether the wager is triggered is based upon a first derivative of the continuous variable.

6. A gaming system for providing a gambling hybrid game that includes an entertainment game and a gambling game, comprising:

a processing device constructed to:

execute the entertainment game, wherein the entertainment game updates a value for each entertainment game variable in a set of entertainment game variables and the set of entertainment game variables represents a state of the entertainment game, including at least one entertainment game variable;

communicate, to a game world server, a signal including a trigger of a wager based on the player's action during the player's skillful play of the entertainment game;

receive, from the game world server, a signal including a result of the wager triggered based on the player's action during the player's skillful play of the entertainment game;

display the result of the wager triggered based on the player's action during the player's skillful play of the entertainment game;

display an amount of intermediate in-game user resources that may be used to purchase or enable in-game resources based on the result of the wager triggered based on the player's action during the player's skillful play of the entertainment game;

communicate, to the game world server, a signal including the value for each entertainment game variable in the set of entertainment game variables; and receive, from the game world server, a signal including a change in the set of entertainment game variables; and the game world server, connected to the processing device via a network and connected to a real world server via a communication link, constructed to:

continuously monitor the processing device for the signal including the trigger of the wager based on the player's action during the player's skillful play of the entertainment game;

receive, from the processing device, the signal including the trigger of the wager based on the player's action during the player's skillful play of the entertainment game;

communicate, to the real world server, the signal including the trigger of the wager based on the player's action during the player's skillful play of the entertainment game;

receive, from the real world server, the signal including the result of the wager triggered based on the player's action during the player's skillful play of the entertainment game;

calculate the amount of intermediate in-game user resources that may be used to purchase or enable in-game resources based on the result of the wager triggered based on the player's action during the player's skillful play of the entertainment game;

communicate, to the processing device, the signal including the result of the wager triggered based on the player's action during the player's skillful play of the entertainment game and the amount of intermediate in-game user resources;

receive, from the processing device, the signal including the value for each entertainment game variable in the set of entertainment game variables;

determine a wager in the gambling game is triggered based upon the signal including the value for each entertainment game variable in the set of entertainment game variables;

communicate, to the real world server, a signal including a trigger to resolve the wager based upon the signal including the value for each entertainment game variable in the set of entertainment game variables;

receive, from the real world server, a result of the wager based upon the signal including the value for each entertainment game variable in the set of entertainment game variables;

determine the change to the set of entertainment game variables based upon the result of the wager based upon the signal including the value for each entertainment game variable in the set of entertainment game variables; and communicate, to the processing device, the signal including the change to the set of entertainment game variables.

7. The gaming system of claim 6, wherein one variable in the set of entertainment game variables is a discrete variable and Boolean logic is used to determine whether the wager is triggered based on the discrete variable.

8. The gaming system of claim 7 wherein one variable in the set of entertainment game variables is a continuous variable and the determination of whether the gambling event is triggered is based upon a second derivative of the continuous variable.

9. The gaming system of claim 6, wherein one variable in the set of entertainment game variables is a continuous variable and the determination of whether the wager is triggered is based upon a comparison of the value of the continuous variable to a threshold value.

10. The gaming system of claim 6, wherein one variable in the set of entertainment game variables is a continuous variable and the determination of whether the wager is triggered is based upon a first derivative of the continuous variable.

11. A gaming system for providing a gambling hybrid game that includes an entertainment game and a gambling game, comprising:

a real world server constructed to:

receive, from a game world server, a signal including a trigger of a wager based on a player's action during the player's skillful play of the entertainment game;

determine a result of the wager triggered based on the player's action during the player's skillful play of the entertainment game;

communicate, to the game world server, a signal including the result of the wager triggered based on the player's action during the player's skillful play of the entertainment game;

receive, from the game world server, a signal including a trigger to resolve the wager based upon a signal including the value for each entertainment game variable in the set of entertainment game variables;

determine the result of the wager based upon the signal including the value for each entertainment game variable in the set of entertainment game variables; and communicate, to the game world server, the result of the wager based upon the signal including the value for each entertainment game variable in the set of entertainment game variables; and the game world server, connected to a processing device via a network and connected to the real world server via a communication link, constructed to:

continuously monitor the processing device for the signal including the trigger of the wager based on the player's action during the player's skillful play of the entertainment game;

receive, from the processing device, the signal including the trigger of the wager based on the player's action during the player's skillful play of the entertainment game;

communicate, to the real world server, the signal including the trigger of the wager based on the player's action during the player's skillful play of the entertainment game;

receive, from the real world server, the signal including the result of the wager triggered based on the player's action during the player's skillful play of the entertainment game;

calculate the amount of intermediate in-game user resources that may be used to purchase or enable in-game resources based on the result of the wager triggered based on the player's action during the player's skillful play of the entertainment game;

communicate, to the processing device, the signal including the result of the wager triggered based on the player's action during the player's skillful play of the entertainment game and the amount of intermediate in-game user resources;

receive, from the processing device, the signal including the value for each entertainment game variable in the set of entertainment game variables;

determine the wager in the gambling game is triggered based upon the signal including the value for each entertainment game variable in the set of entertainment game variables;

communicate, to the real world server, the signal including the trigger to resolve the wager based upon the signal including the value for each entertainment game variable in the set of entertainment game variables;

receive, from the real world server, the result of the wager based upon the signal including the value for each entertainment game variable in the set of entertainment game variables;

determine a change to the set of entertainment game variables based upon the result of the wager based upon the signal including the value for each entertainment game variable in the set of entertainment game variables; and communicate, to the processing device, a signal including the change to the set of entertainment game variables.

12. The gaming system of claim 11, wherein one variable in the set of entertainment game variables is a discrete variable and Boolean logic is used to determine whether the wager is triggered based on the discrete variable.

13. The gaming system of claim 12 wherein one variable in the set of entertainment game variables is a continuous variable and the determination of whether the wager is triggered is based upon a second derivative of the continuous variable.

14. The gaming system of claim 11, wherein one variable in the set of entertainment game variables is a continuous variable and the determination of whether the wager is triggered is based upon a comparison of the value of the continuous variable to a threshold value.

15. The gaming system of claim 11, wherein one variable in the set of entertainment game variables is a continuous variable and the determination of whether the wager is triggered is based upon a first derivative of the continuous variable.

* * * * *